US010429771B2

(12) United States Patent
Shimodaira et al.

(10) Patent No.: US 10,429,771 B2
(45) Date of Patent: Oct. 1, 2019

(54) TRANSFER DEVICE AND IMAGE FORMING APPARATUS

(71) Applicant: FUJI XEROX CO.,LTD., Tokyo (JP)

(72) Inventors: Yoshiki Shimodaira, Kanagawa (JP); Masaaki Yamaura, Kanagawa (JP); Toshiaki Baba, Kanagawa (JP); Satoshi Shigezaki, Kanagawa (JP)

(73) Assignee: FUJI XEROX CO.,LTD., Tokyo (JP)

( * ) Notice: Subject to any disclaimer, the term of this patent is extended or adjusted under 35 U.S.C. 154(b) by 0 days.

(21) Appl. No.: 15/981,909

(22) Filed: May 17, 2018

(65) Prior Publication Data

US 2018/0364622 A1 Dec. 20, 2018

(30) Foreign Application Priority Data

Jun. 15, 2017 (JP) ..... 2017-118002

(51) Int. Cl.
*G03G 15/08* (2006.01)
*G03G 15/16* (2006.01)

(52) U.S. Cl.
CPC ..... *G03G 15/165* (2013.01); *G03G 15/1615* (2013.01); *G03G 15/169* (2013.01)

(58) Field of Classification Search
CPC ..... G03G 15/065; G03G 15/5058; G03G 15/0806; G03G 15/5008; G03G 15/556
USPC ..... 399/53
See application file for complete search history.

(56) References Cited

U.S. PATENT DOCUMENTS 3,975,013 A * 8/1976 Deisting ..... B65H 5/023 271/275
2006/0216056 A1* 9/2006 Okabe ..... G03G 15/0131 399/101
2013/0016984 A1* 1/2013 Suzuki ..... G03G 15/0189 399/38
2018/0364617 A1* 12/2018 Yuasa ..... G03G 15/0865

FOREIGN PATENT DOCUMENTS

JP 2015-135394 7/2015
JP 2016-186636 10/2016

OTHER PUBLICATIONS

"What is Printer Toner" downloaded from the Internet on Dec. 28, 2018. Publication date: Jul. 14, 2017.*

* cited by examiner

*Primary Examiner* — Walter L Lindsay, Jr.
*Assistant Examiner* — Frederick Wenderoth
(74) *Attorney, Agent, or Firm* — JCIPRNET

(57) ABSTRACT

A transfer device includes a holding body that holds a toner image and to which a first tension and a second tension, which is smaller than the first tension, are applied, a transfer body that transfers the toner image to a recording medium while transporting the recording medium between the transfer body and the holding body, and a setting portion that sets tension applied to the holding body to the second tension when a mass of a toner of an uppermost toner layer constituting the toner image and disposed on the holding body is equal to or exceeds a threshold.

8 Claims, 25 Drawing Sheets

FIG. 11A

| | | W | K | Y, M, C |
|---|---|---|---|---|
| TENSION | | SECOND TENSION (63 [N]) | FIRST TENSION (65 [N]) | FIRST TENSION (65 [N]) |
| EVALUATION RESULT | ORDINARY PAPER | FAIR | FAIR | FAIR |
| | THICK PAPER | FAIR | FAIR | FAIR |

FIG. 11B

| | | W | K | Y, M, C |
|---|---|---|---|---|
| TENSION | | FIRST TENSION (65 [N]) | FIRST TENSION (65 [N]) | FIRST TENSION (65 [N]) |
| EVALUATION RESULT | ORDINARY PAPER | FAIR | FAIR | FAIR |
| | THICK PAPER | POOR | FAIR | FAIR |

TRANSFER DEVICE AND IMAGE FORMING APPARATUS

CROSS-REFERENCE TO RELATED APPLICATIONS

This application is based on and claims priority under 35 USC 119 from Japanese Patent Application No. 2017-118002 filed Jun. 15, 2017.

BACKGROUND

Technical Field

The present invention relates to a transfer device and an image forming apparatus.

SUMMARY

According to an aspect of the invention, a transfer device includes a holding body that holds a toner image and to which a first tension and a second tension, which is smaller than the first tension, are applied, a transfer body that transfers the toner image to a recording medium while transporting the recording medium between the transfer body and the holding body, and a setting portion that sets tension applied to the holding body to the second tension when a mass of a toner of an uppermost toner layer constituting the toner image and disposed on the holding body is equal to or exceeds a threshold.

BRIEF DESCRIPTION OF THE DRAWINGS

Exemplary embodiments of the present invention will be described in detail based on the following figures, wherein:

FIGS. 11A and 11B are tables of evaluation results for the image forming apparatus according to the first exemplary embodiment of the present invention and evaluation results for an image forming apparatus according to a comparative example;

DETAILED DESCRIPTION

First Exemplary Embodiment

Examples of a transfer device and an image forming apparatus according to a first exemplary embodiment of the present invention are described with reference to FIGS. 1A to 18. The arrow H shown in these drawings denotes the vertical direction and an apparatus height direction, the arrow W denotes the horizontal direction and an apparatus width direction, and the arrow D denotes the horizontal direction and an apparatus depth direction.

Entire Structure

Figure 14:
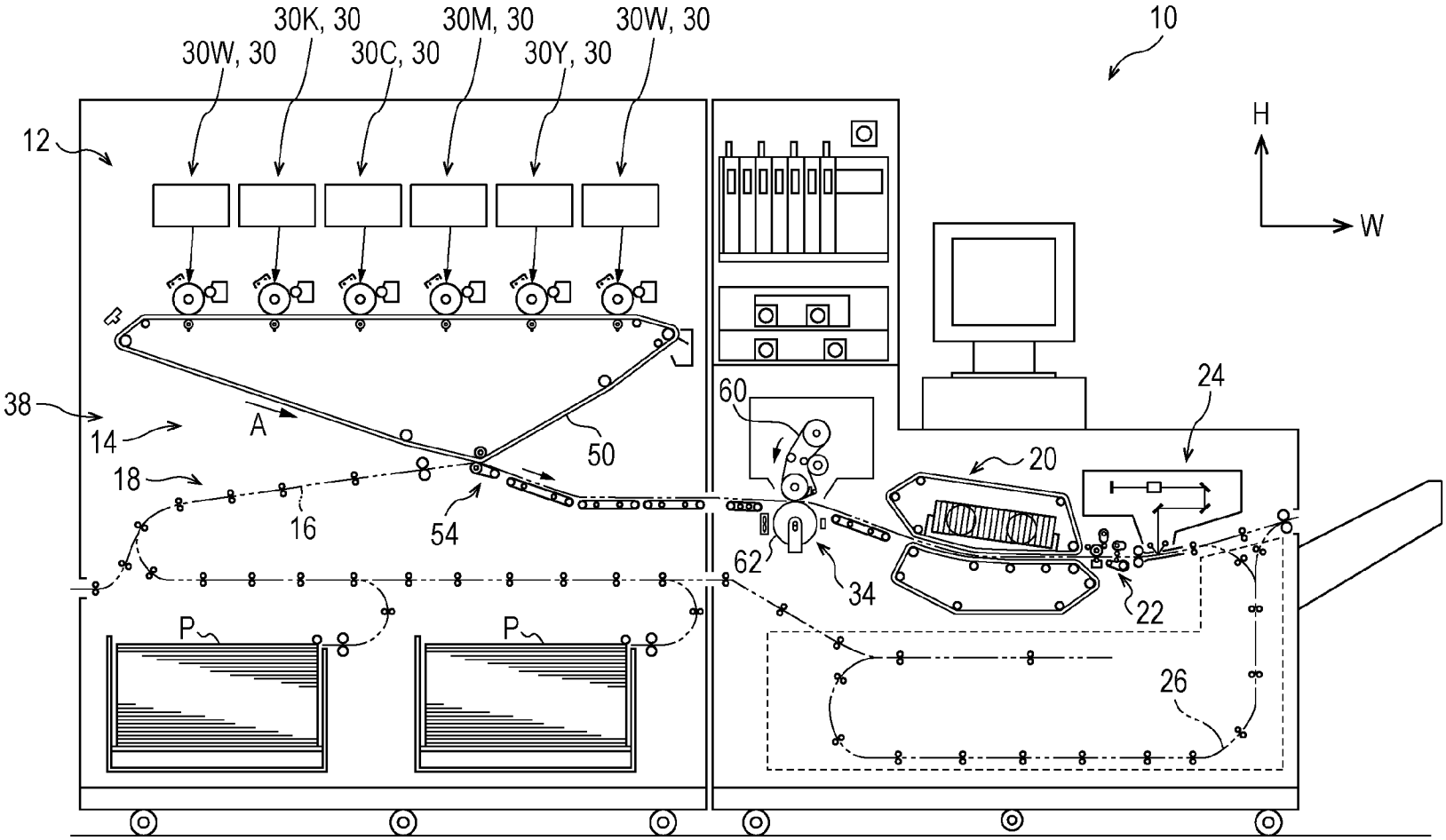
FIG. 14 is a diagram of the structure of the image forming apparatus according to the first exemplary embodiment of the present invention.

As illustrated in FIG. 14, an image forming apparatus 10 includes an image forming unit 12, which forms images by electrophotography, and a transport device 18, which includes multiple transport rollers (not denoted with reference signs), which transport a sheet member P (an example of a recording medium) along a transport path 16 for the sheet member P.

The image forming apparatus 10 includes a cooling portion 20, which cools a sheet member P on which an image is formed, a correcting portion 22, which corrects bending of a sheet member P, and an image inspecting portion 24, which inspects an image formed on a sheet member P.

The image forming apparatus 10 also includes a reverse path 26, which reverses a sheet member P having an image formed on its top surface and transports the sheet member P again toward the image forming unit 12 to form images on both surfaces of the sheet member P.

The image forming apparatus 10 having the above structure forms an image (toner image) formed by the image forming unit 12 on the top surface of a sheet member P transported along the transport path 16. The sheet member P having an image formed thereon passes through the cooling portion 20, the correcting portion 22, and the image inspecting portion 24 in this order to be discharged to the outside of the apparatus.

When an image is to be formed on the back surface of a sheet member P, a sheet member P having an image formed on its top surface is transported along the reverse path 26 and the image forming unit 12 forms an image again on the back surface of the sheet member P.

Image Forming Unit

The image forming unit 12 includes multiple toner layer forming portions 30, which respectively form toner layers of various colors, a transfer belt 50, which holds a toner image formed from one or more toner layers, and a transfer portion 14, which transfers a toner image to a sheet member P. The image forming unit 12 also includes a setting portion 58 (see FIG. 2), which sets tension applied to the transfer belt 50, and a fixing device 34, which fixes a toner image transferred to a sheet member P by the transfer portion 14 onto the sheet member P.

The multiple toner layer forming portions 30 form toner layers of different colors. In the present exemplary embodiment, the toner layer forming portions 30 are prepared for five colors of yellow (Y), magenta (M), cyan (C), black (K), and white (W). Reference characters Y, M, C, K, and W appended to the reference numerals in FIG. 14 represent the above colors. In the present exemplary embodiment, yellow (Y), magenta (M), cyan (C), and black (K) are basic colors to output a color image. Two toner layer forming portions 30 are prepared for white (W).

In the following description, the characters Y, M, C, K, and W appended to the reference numerals are omitted unless yellow (Y), magenta (M), cyan (C), black (K), and white (W) need to be distinguished from each other. Hereinbelow, yellow (Y), magenta (M), cyan (C), and black (K) may be collectively referred to as "non-white colors".

Figure 12:
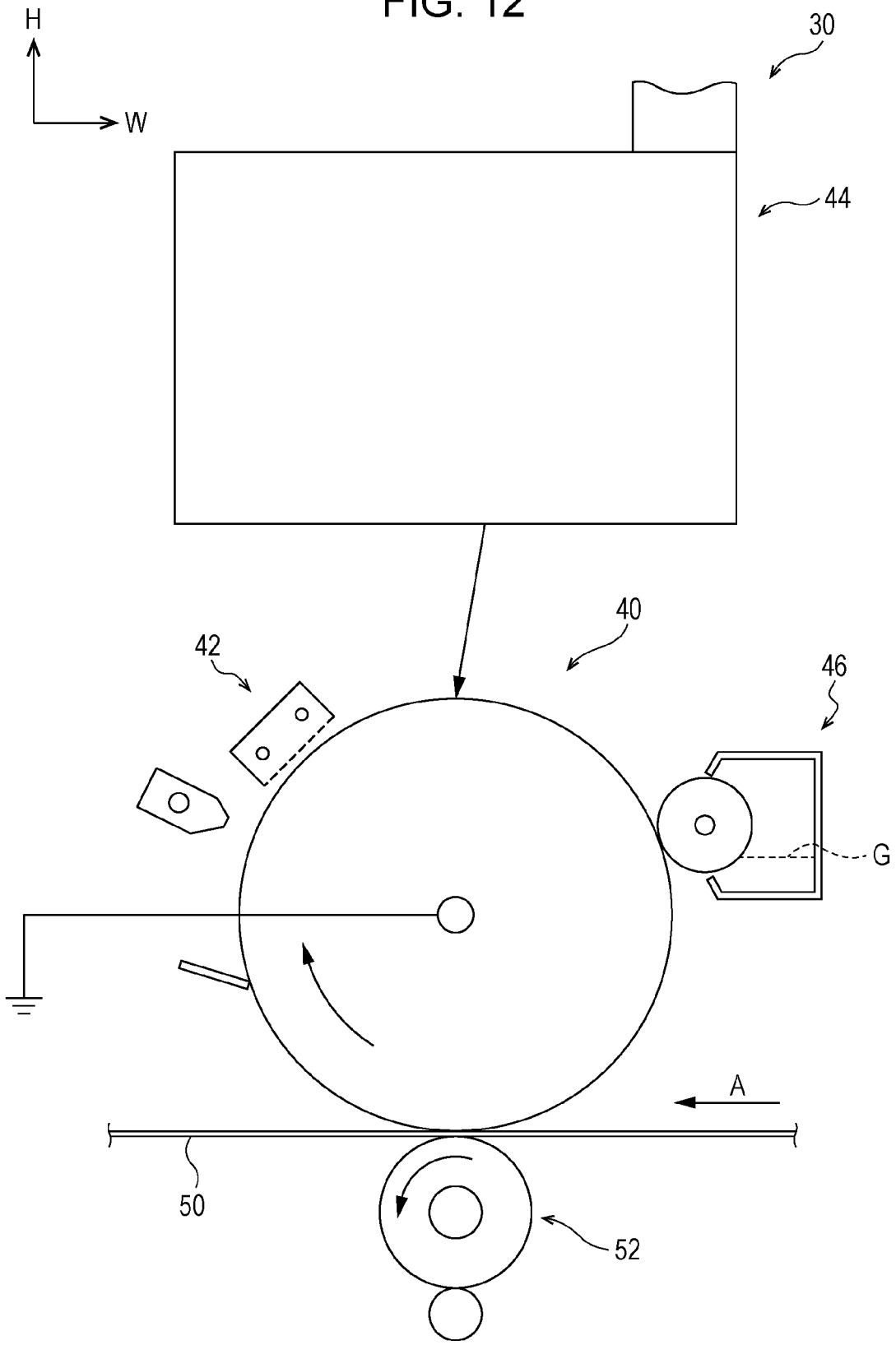
FIG. 12 is a diagram of the structure of a toner layer forming portion of the image forming apparatus according to the first exemplary embodiment of the present invention.

The toner layer forming portions 30 for various colors basically have the same structure except for using different color toners. As illustrated in FIG. 12, each toner layer forming portion 30 includes a rotating cylindrical image carrier 40, and a charging device 42, which charges the image carrier 40. Each toner layer forming portion 30 also includes an exposure device 44, which irradiates the charged image carrier 40 with exposure light to form an electrostatic latent image on the image carrier 40, and a developing device 46, which develops an electrostatic latent image with a developer G containing toner into a toner layer. Here, the developer G used in the present exemplary embodiment is a binary developer containing a toner and a carrier.

Figure 13:
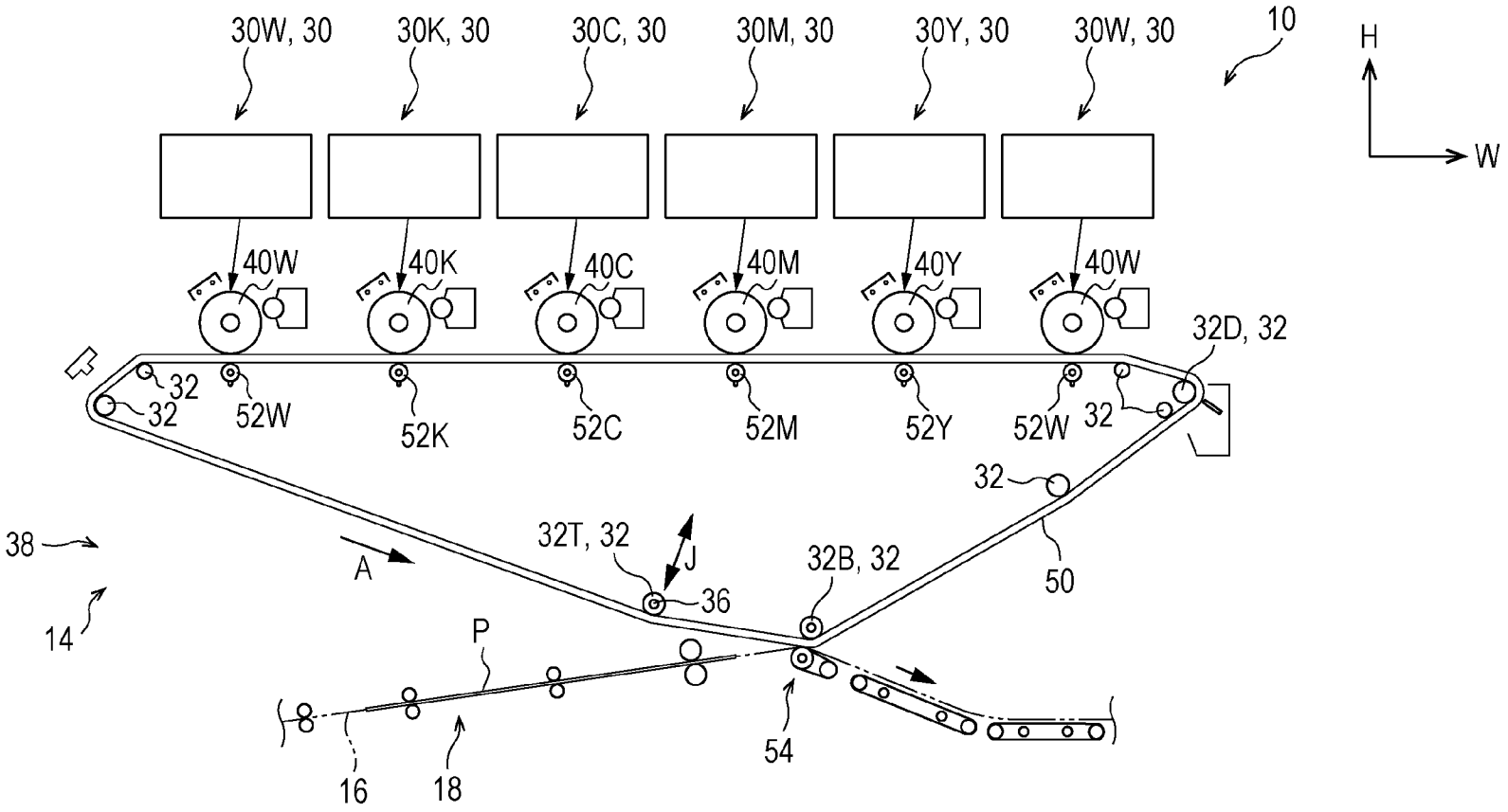
FIG. 13 is a diagram of the structure of the toner layer forming portion and a transfer portion of the image forming apparatus according to the first exemplary embodiment of the present invention.

Each image carrier 40 for the corresponding color is grounded and touches the rotating transfer belt 50 (described in detail below). As illustrated in FIG. 13, the toner layer forming portions 30 for white (W), yellow (Y), magenta (M), cyan (C), black (K), and white (W) are arranged in this order in the horizontal direction from the upstream side in the direction in which the transfer belt 50 is rotated (see the arrow A in the drawing).

As illustrated in FIG. 13, the transfer portion 14 includes first transfer rollers 52, which rotate and transfer toner layers formed on the image carriers 40 of the corresponding colors to the transfer belt 50. The transfer portion 14 also includes a second transfer portion 54, which transfers a toner image formed from one or more toner layers transferred to the transfer belt 50 onto a sheet member P. The transfer portion 14, the transfer belt 50, and the setting portion 58 are described in detail below.

As illustrated in FIG. 14, the fixing device 34 includes a fixing belt 60, which is wound around multiple rollers (not denoted with reference signs) and heated, and a pressing roller 62, which presses a sheet member P against the fixing belt 60. In this structure, the rotating fixing belt 60 and the pressing roller 62 transport a sheet member P to which a toner image has been transferred while holding the sheet member P therebetween, so as to fix the toner image to the sheet member P.

Structure of Related Portion

The following describes toners used in the developing device 46, the transfer belt 50, serving as an example of a holding body, the transfer portion 14, serving as an example of a transfer body, and a setting portion 58, which sets tension applied to the transfer belt 50. The transfer belt 50, the transfer portion 14, and the setting portion 58 are included in a transfer device 38.

Toners Used in Developing Device 46

The developing device 46W employs a white toner 200 (also referred to as "a W toner", below), and the developing devices 46Y, 46M, 46C, and 46K employ color toners 300 for non-white colors. Now, the white toner 200 and the color toners 300 are described.

The white toner 200 is used on the sheet member P as a base coat for non-white colors. Specifically, a solid layer (solid image) of the white toner 200 is formed on a sheet member P as a base coat for non-white colors to enhance color reproduction of the toner image.

When the sheet member P is a paper medium, a W toner layer, a K toner layer, a C toner layer, a M toner layer, and a Y toner layer are superposed one on top of another in this order on the sheet member P, which is a paper medium. When, on the other hand, the sheet member P is a transparent film, a K toner layer, a C toner layer, a M toner layer, a Y toner layer, and a W toner layer are superposed one on top of another in this order on the sheet member P to allow an image to be viewed through the film.

White Toner 200

Figure 4A:
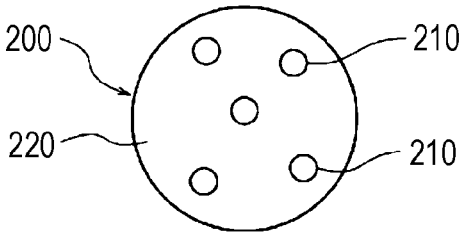
FIGS. 4A and 4B are schematic diagrams of a white toner and a color toner used in the image forming apparatus according to the first exemplary embodiment of the present invention.

As illustrated in FIG. 4A, the white toner 200 contains a spherical pigment 210 and a binding resin 220. The spherical pigment 210 is formed from a titanium oxide (an example of a metallic oxide). The binding resin 220 is formed from a known resin material. The binding resin 220 is less electrically conductive than the spherical pigment 210.

Figure 5A:
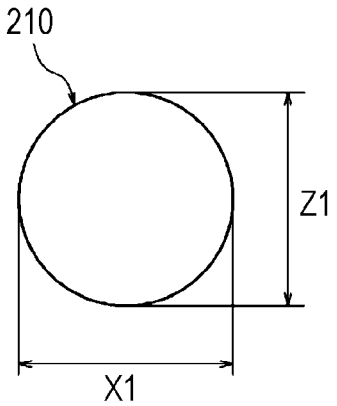
FIGS. 5A and 5B are schematic diagrams of a pigment of a white toner used in the image forming apparatus according to the first exemplary embodiment of the present invention.
Figure 5B:
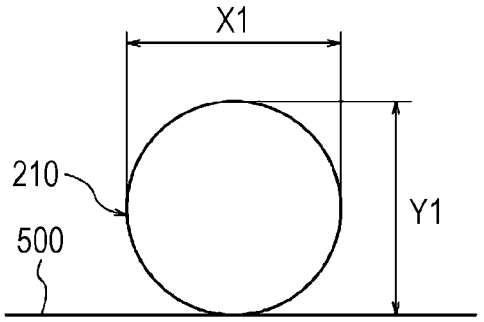

In the state where the spherical pigment 210 is placed on a flat surface 500, a lateral dimension X1 and a front-rear dimension Z1 of the spherical pigment 210, viewed from the top in FIG. 5A, are equal to the lateral dimension X1 and a vertical dimension Y1 of the spherical pigment 210, viewed from the side in FIG. 5B.

Figure 6A:
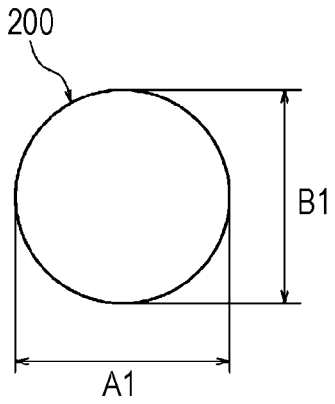
FIGS. 6A and 6B are schematic diagrams of the white toner used in the image forming apparatus according to the first exemplary embodiment of the present invention.
Figure 6B:
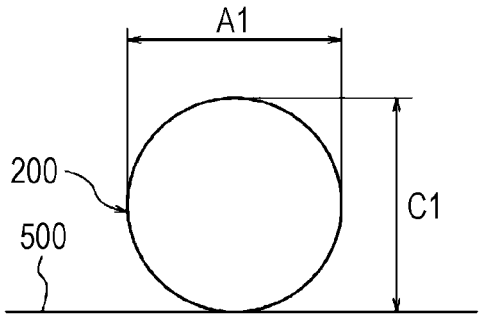

The white toner 200 containing the spherical pigment 210 is also spherical in the same manner as the spherical pigment 210. Thus, when the white toner 200 is placed on the flat surface 500, a lateral dimension A1 and a front-rear dimension B1 of the white toner 200, viewed from the top in FIG. 6A, are equal to the lateral dimension A1 and a vertical dimension C1 of the white toner 200, viewed from the side in FIG. 6B.

The volumetric average particle diameter of the spherical pigment 210 or the white toner 200 is measured by using, for example, Coulter counter TAII (from Nikkaki Bios Co., Ltd.) or multisizer II (from Nikkaki Bios Co., Ltd.). Specifically, within a particle range (channel) separated on the basis of the particle size distribution measured with this measuring instrument, the cumulative distribution is plotted from the smaller diameter with respect to the volume, and the particle diameter (D50v) of the cumulative percentage of 50% is used as a volumetric average particle diameter. Other volumetric average particle diameters below are measured similarly.

The standard volumetric average particle diameter of the spherical pigment 210 falls within a range of approximately 200 nm to 300 nm. The standard volumetric average particle diameter of the white toner 200 falls within a range of approximately 4 μm to 14 μm.

In the present exemplary embodiment, the volumetric average particle diameter of the white toner 200 is 8.5 μm, and the specific gravity of the white toner 200 is 1.6 g/cm$^3$. Thus, the average mass (an example of mass) of the white toner 200 is $0.51\times10^{-9}$ g.

Color Toner 300

Figure 4B:
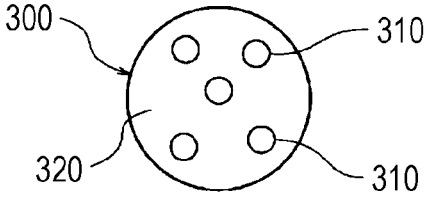

As illustrated in FIG. 4B, each color toner 300 does not contain the spherical pigment 210. The color toner 300 contains a pigment 310, other than the spherical pigment 210, and a binding resin 320. The pigment 310 is formed of, for example, a nonmetal and nonmetallic oxide pigment (for example, an organic pigment). Specifically, the color toner 300 contains a pigment less electrically conductive than the spherical pigment 210. The binding resin 320 is formed of a known resin material.

Figure 7A:
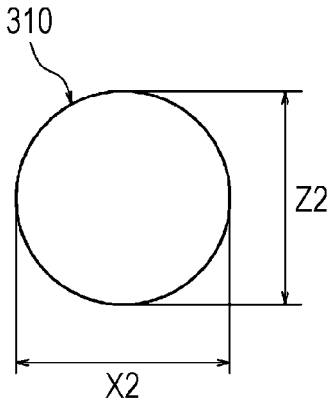
FIGS. 7A and 7B are schematic diagrams of a pigment of the color toner used in the image forming apparatus according to the first exemplary embodiment of the present invention.
Figure 7B:
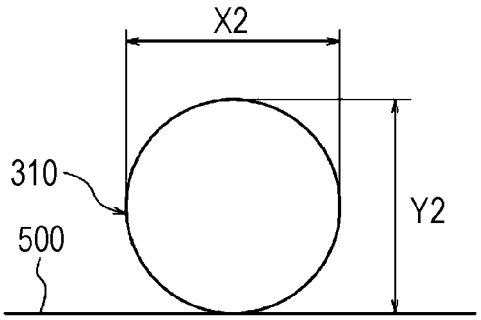

In the state where the spherical pigment 310 is placed on the flat surface 500, a lateral dimension X2 and a front-rear dimension Z2 of the spherical pigment 310, viewed from the top in FIG. 7A, are equal to the lateral dimension X2 and a vertical dimension Y2 of the spherical pigment 310, viewed from the side in FIG. 7B. Specifically, the pigment 310 is approximately spherical.

Figure 8A:
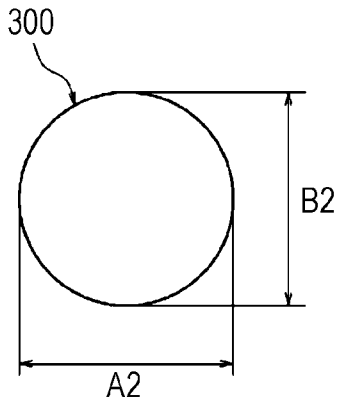
FIGS. 8A and 8B are schematic diagrams of the color toner used in the image forming apparatus according to the first exemplary embodiment of the present invention.
Figure 8B:
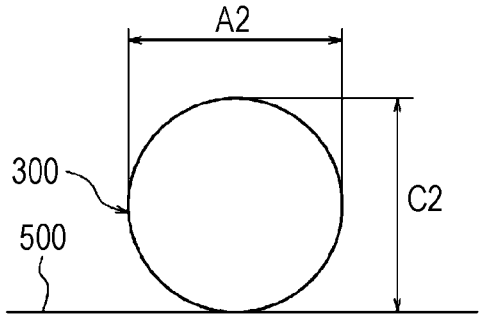

Similarly to the pigment 310, the color toner 300 containing the pigment 310 is also spherical. Thus, when the color toner 300 is placed on the flat surface 500, a lateral dimension A2 and a front-rear dimension B2 of the color toner 300, viewed from the top in FIG. 8A, are equal to the lateral dimension A2 and a vertical dimension C2, viewed from the side in FIG. 8B of the color toner 300.

The volumetric average particle diameter of the pigment 310 falls within the range of approximately 50 nm to 150 nm. The volumetric average particle diameter of the color toner 300 falls within the range of 3 μm to 9 μm. When the volumetric average particle diameter exceeds 9 μm, the image may have a low resolution. On the other hand, when the volumetric average particle diameter falls below 3 μm, the toner may be charged insufficiently and the developed image may have low quality.

Here, in the present exemplary embodiment, for each of the Y toner, the M toner, and the C toner, a toner having a specific gravity of 1.1 g/cm$^3$ and a volumetric average particle diameter of 4.7 μm is used. For the K toner, a toner having a specific gravity of 1.2 g/cm$^3$ and a volumetric average particle diameter of 4.7 μm is used. Thus, the Y toner, the M toner, and the C toner have a mass of $0.6\times10^{-10}$ g, and the K toner has a mass of $0.65\times10^{-10}$ g.

The color toner 300 may contain a compound formed from a divalent or polyvalent metallic element. The compound is added as, for example, a coagulant to form the color toner 300 by emulsion polymerization aggregation. The content of the compound in the color toner 300 falls within a range of, for example, 0.05 percent by mass to 2 percent by mass.

Transfer Belt 50

As illustrated in FIG. 13, the transfer belt 50 is endless and wound around multiple rollers 32. The transfer belt 50 is in a position of an inverted obtuse triangle, long in the apparatus width direction in a front view. In the present exemplary embodiment, the transfer belt 50 is made of a material obtained by dispersing carbon in polyimide. The transfer belt 50 has a volume resistivity of 12.5 log ohm-cm.

Transfer Portion 14

The transfer portion 14 includes multiple rollers 32, around which the transfer belt 50 is wound, and first transfer rollers 52 for various colors, which transfer the toner layers formed on the image carriers 40 for the various colors to the transfer belt 50. The transfer portion 14 also includes a second transfer portion 54, which transfers the toner image transferred to the transfer belt 50 to the sheet member P, and eccentric cams 72 (see FIG. 2), which move a roller 32T, described below.

Rollers 32

Multiple rollers 32 include a roller 32D disposed on a first end (on the right side) in the apparatus width direction. The roller 32D rotates the transfer belt 50 in the direction of arrow A (counterclockwise in the drawing) with a rotational force transmitted from a motor, not illustrated. In the present exemplary embodiment, the roller 32D is a cylindrical metal roller having an outer diameter of 28 mm.

The multiple rollers 32 include a roller 32B, around which the lower end vertex forming an obtuse angle of the transfer belt 50 taking an obtuse triangle position is wound. The roller 32B faces the second transfer portion 54 with the transfer belt 50 interposed therebetween. A transfer current is fed to the roller 32B. In the present exemplary embodiment, the roller 32B is an elastic roller having an outer diameter of 28 mm. The roller 32B has a surface resistance of 7.3 log ohm/sq. The roller 32B has a surface hardness of 53 degrees in Asker C hardness.

The multiple rollers 32 include a roller 32T on the upstream side of and adjacent to the roller 32B in the direction in which the transfer belt 50 rotates (hereinafter referred to as "a belt rotation direction"). The roller 32T applies tension to the transfer belt 50. Specifically, a slope portion of the transfer belt 50 is wound around the roller 32T. The slope portion of the transfer belt 50 tilts from the horizontal direction. To change the tension applied to the transfer belt 50 with a movement of the roller 32T, a guide rail that guides a rotation shaft 36 of the roller 32T and that is not illustrated is disposed to extend in a direction of arrow J in the drawing when viewed in the apparatus depth direction. In the present exemplary embodiment, the roller 32T is a cylindrical metal roller having an outer diameter of 28 mm.

Eccentric Cams 72

Figure 1A:
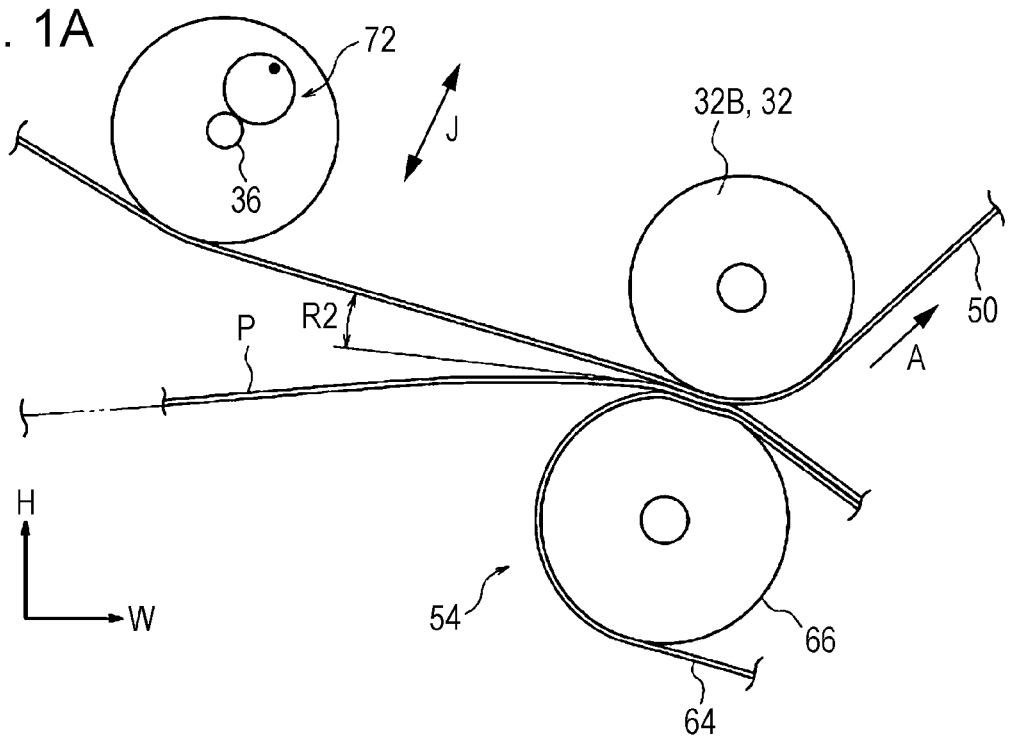
FIGS. 1A and 1B are side views of components, such as a second transfer portion and a transfer belt, of an image forming apparatus according to a first exemplary embodiment of the present invention.
Figure 1B:
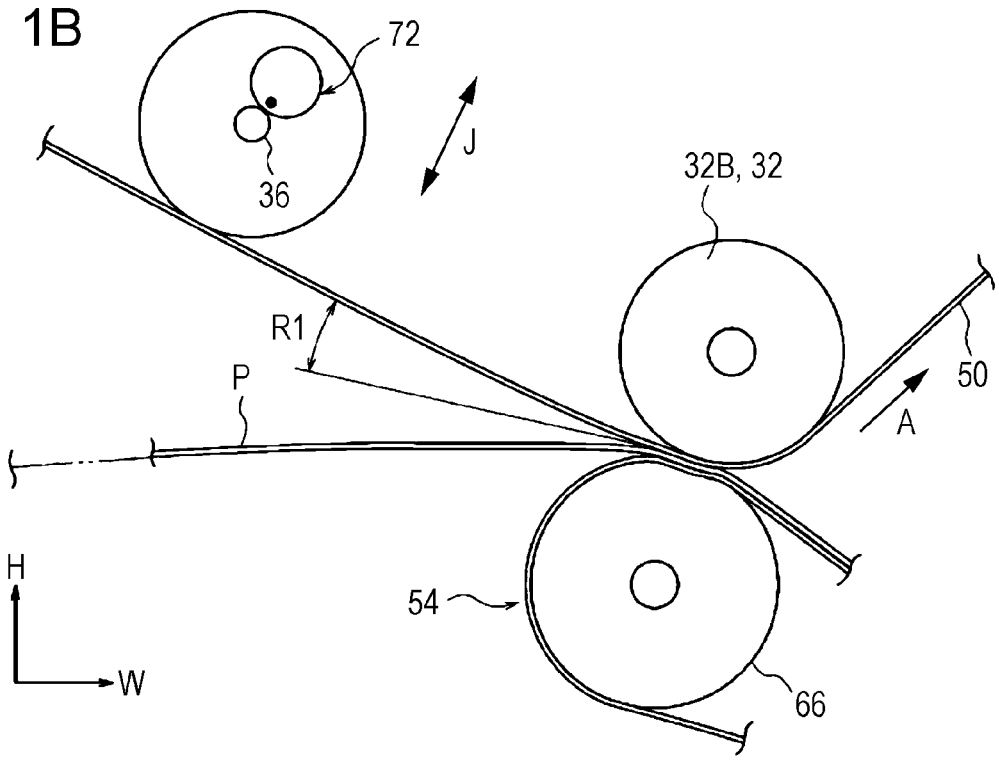
Figure 2:
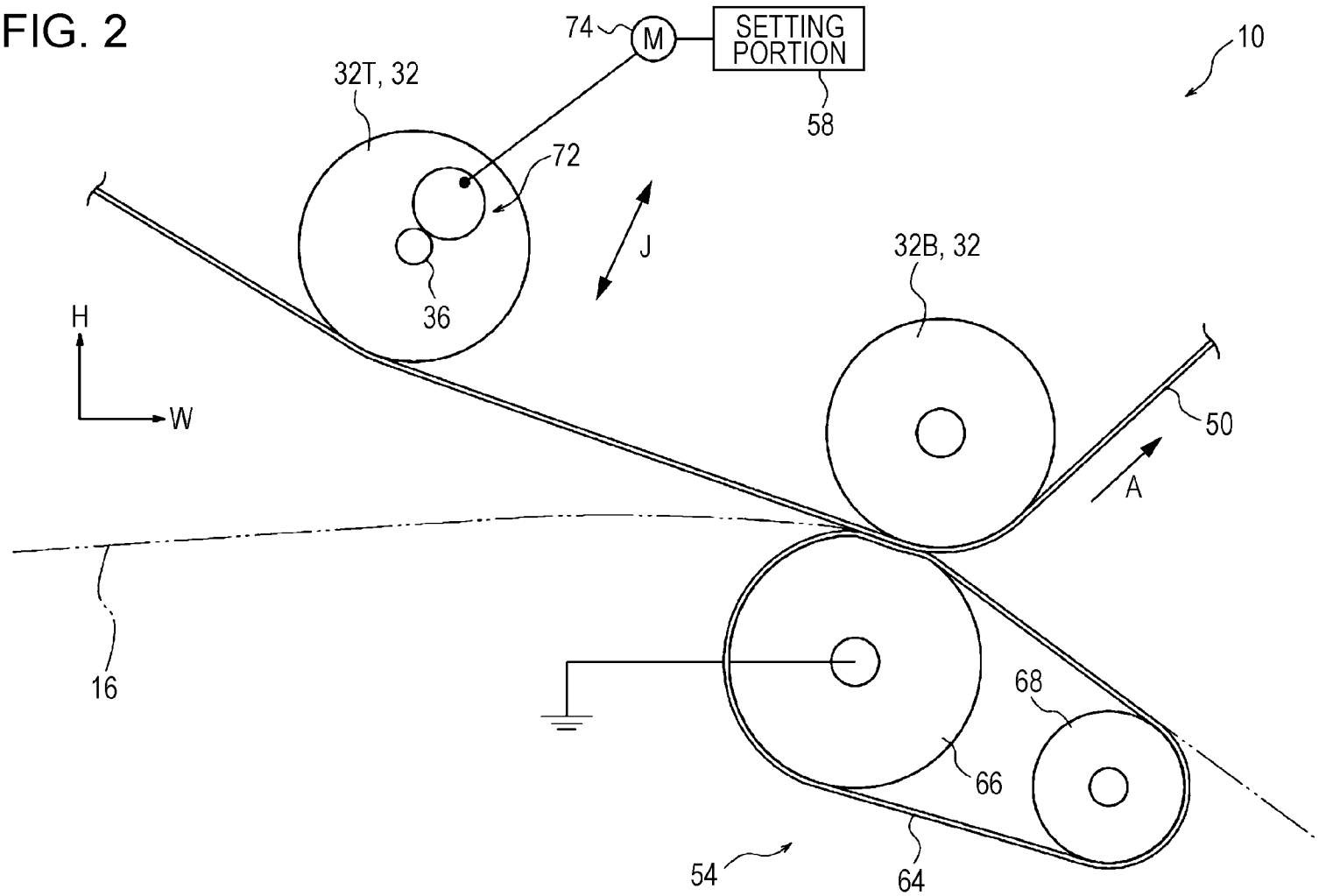
FIG. 2 is a side view of components, such as the second transfer portion and the transfer belt, of the image forming apparatus according to the first exemplary embodiment of the present invention.

As illustrated in FIG. 2, a pair of eccentric cams 72 are disposed so as to hold the roller 32T therebetween in the apparatus depth direction such that the outer circumferential surfaces of the eccentric cams 72 touch the rotation shaft 36 of the roller 32T. On the outer circumferential surface of each eccentric cam 72, an urging member, not illustrated, is disposed. The urging member urges the rotation shaft 36 of the roller 32T to bring the rotation shaft 36 into contact with the eccentric cams 72.

In this structure, the eccentric cams 72 rotate with the rotational force of a stepping motor 74 ("the motor 74", below), which rotates the eccentric cams 72, to move the roller 32T to change the tension applied to the transfer belt 50 (see FIGS. 2 and 3).

First Transfer Rollers 52

As illustrated in FIG. 13, the first transfer rollers 52 are disposed so as to face the image carriers 40 of the respective colors with the transfer belt 50 interposed therebetween. In the present exemplary embodiment, the first transfer rollers 52 are elastic rollers having an outer diameter of 28 mm. The first transfer rollers 52 have a resistance of 7.71 log ohm and the first transfer rollers 52 have a surface hardness of 30 degrees in Asker C hardness.

In this structure, when a transfer current is fed to each of the first transfer rollers 52 of the corresponding color, a transfer electric field is formed between the first transfer roller 52 and the image carrier 40. This transfer electric field transfers the toner layer on the image carrier 40 to the transfer belt 50, so that the transfer belt 50 holds a toner image formed from one or more toner layers.

Second Transfer Portion 54

As illustrated in FIG. 2, the second transfer portion 54 includes an endless elastic belt 64, and rollers 66 and 68, around which the elastic belt 64 is wound.

In the present exemplary embodiment, the elastic belt 64 is a rubber belt having a thickness of 450 μm and a perimeter of 40 mm. The elastic belt 64 has a volume resistance of 9.2 log ohm.

The roller 66 is grounded and disposed so as to hold the transfer belt 50 and the elastic belt 64 between the roller 66 and the roller 32B. In the present exemplary embodiment, the roller 66 is an elastic roller having an outer diameter of 28 mm. The roller 66 has a resistance of 6.3 log ohm.

The roller 68 is located on the downstream side of the roller 66 in the direction in which the sheet member P is transported along the transport path 16 (hereinafter referred to as "a sheet transport direction"). In the present exemplary embodiment, the roller 68 is a cylindrical metal roller having an outer diameter of 20 mm.

In this structure, a sheet member P transported while being held between the transfer belt 50 and the second transfer portion 54 is pressed against the transfer belt 50. When a transfer current is fed to the roller 32B, a transfer electric field is formed between the roller 32B and the roller 66 of the second transfer portion 54. This transfer electric field transfers the toner image on the transfer belt 50 to the sheet member P that is being transported.

Setting Portion 58

Figure 3:
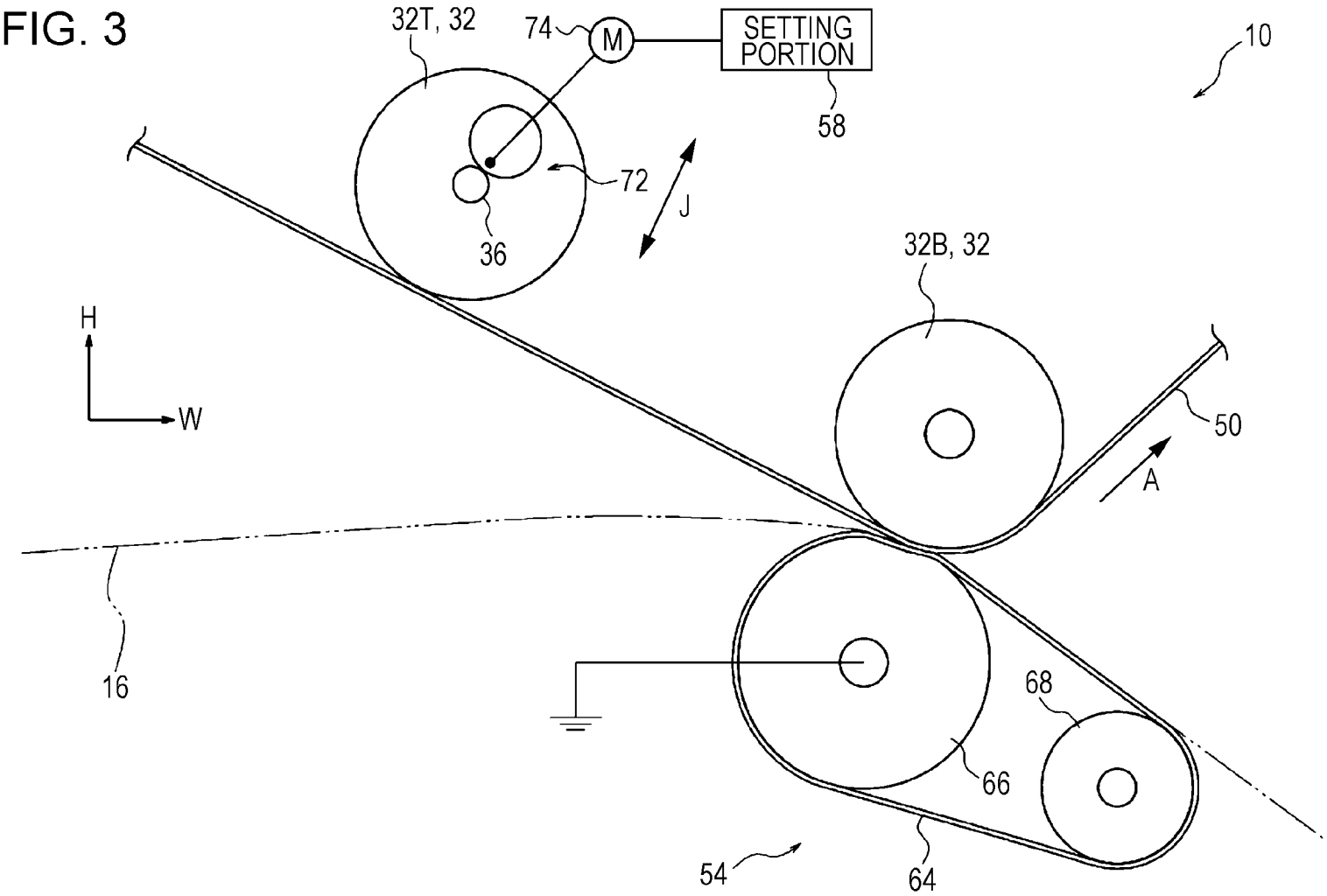
FIG. 3 is a side view of components, such as the second transfer portion and the transfer belt, of the image forming apparatus according to the first exemplary embodiment of the present invention.

As illustrated in FIGS. 2 and 3, the setting portion 58 drives the motor 74 to rotate the eccentric cams 72. The setting portion 58 moves the roller 32T to a position at which it presses the transfer belt 50 with the maximum force (see FIG. 2) or a position at which it presses the transfer belt 50 with the minimum force (see FIG. 3).

In the present exemplary embodiment, when the roller 32T is disposed at the position for pressing the transfer belt 50 with the maximum force, the tension applied to the transfer belt 50 is 65 N (which is an example of a first tension, and may be referred to as "first tension", below). On the other hand, when the roller 32T is disposed at the position for pressing the transfer belt 50 with the minimum force, the tension applied to the transfer belt 50 is 63 N (which is an example of a second tension, and may be referred to as "second tension", below).

When viewed in the apparatus depth direction, an angle formed by the transfer belt 50 and a sheet member P interposed between the transfer belt 50 and the second transfer portion 54 is referred to as a "transport angle". Here, the transport angle (angle R1 in FIG. 1B) when the setting portion 58 sets the tension applied to the transfer belt 50 to the second tension is larger than the transport angle (angle R2 in FIG. 1A) when the setting portion 58 sets the tension applied to the transfer belt 50 to the first tension. In the present exemplary embodiment, the angle R1 is four degrees larger than the angle R2.

To determine the tension applied to the transfer belt 50, for example, compression springs are attached to both ends of the roller 32, and on the basis of the amount of compression of the compression springs, the tension applied to the transfer belt 50 may be calculated.

In this structure, the setting portion 58 receives from a controller, not illustrated, information of the mass of toner (toner particles) of the uppermost toner layer in the toner image on the transfer belt 50. When the mass of the toner is equal to or exceeds a threshold, the setting portion 58 moves the roller 32T to a position at which it presses the transfer belt 50 with the minimum force. When the mass of the toner is below the threshold, the setting portion 58 moves the roller 32T to a position at which it presses the transfer belt 50 with the maximum force. In other words, when the mass of the toner of the uppermost toner layer on the transfer belt 50 is equal to or exceeds the threshold, the setting portion 58 sets the tension applied to the transfer belt 50 to the second tension. When the mass of the toner of the uppermost toner layer on the transfer belt 50 is below the threshold, the setting portion 58 sets the tension applied to the transfer belt 50 to the first tension.

In the present exemplary embodiment, the mass of toner (toner particles) has a threshold of, for example, $2.0\times10^{-10}$ g.

Evaluations

Now, the evaluations of an image forming apparatus 910 according to a comparative example and the image forming apparatus 10 according to the present exemplary embodiment are described. First, the structure of the image forming apparatus 910 according to the comparative example is described, and then, the evaluations of the image forming apparatus 910 according to the comparative example and the image forming apparatus 10 according to the present exemplary embodiment are described.

Image Forming Apparatus 910 According to Comparative Example

Firstly, portions of the image forming apparatus 910 according to the comparative example that differ from those of the image forming apparatus 10 are mostly described.

Figure 15:
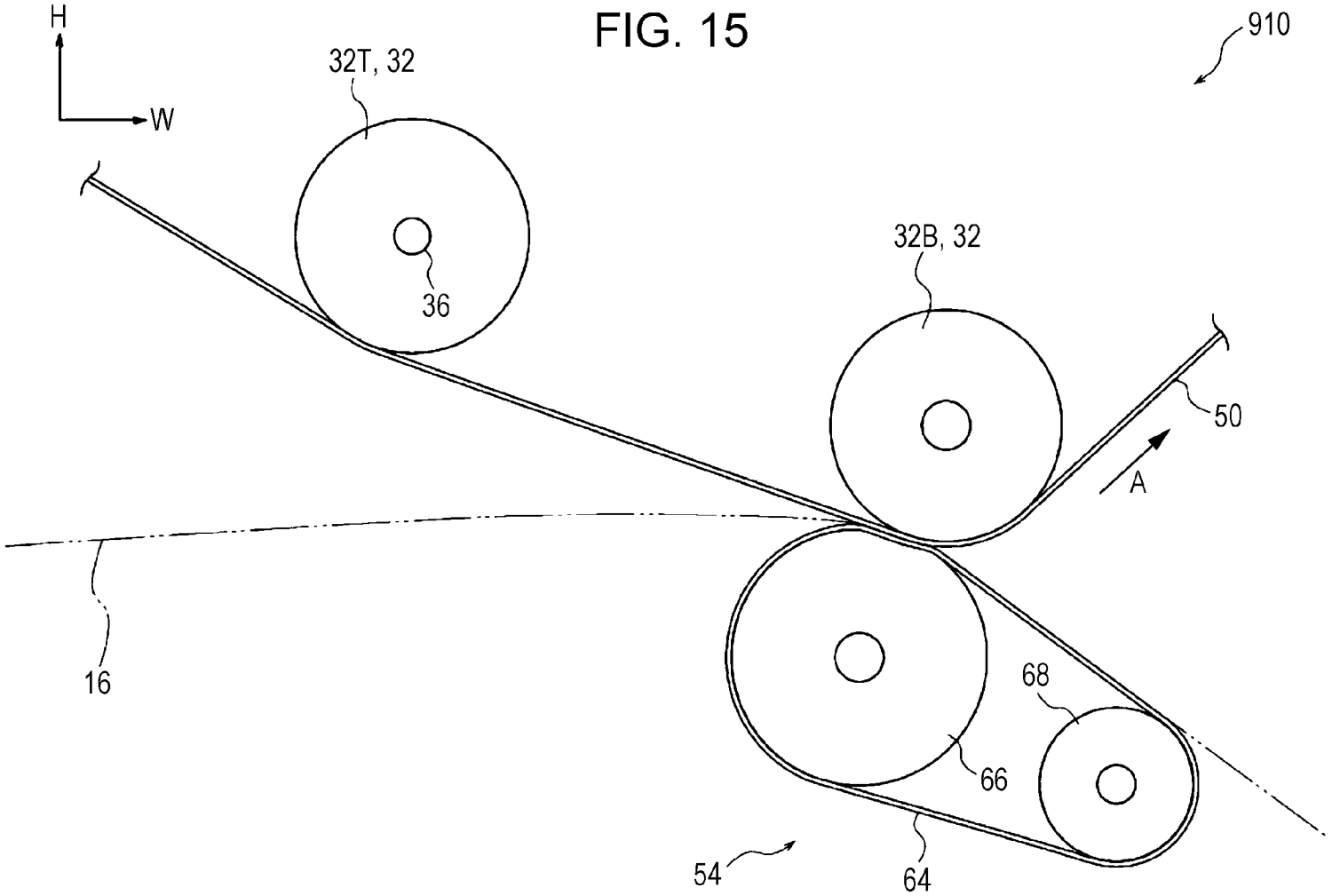
FIG. 15 is a side view of components, such as a second transfer portion and a transfer belt, of an image forming apparatus according to a comparative example, compared with the image forming apparatus according to the first exemplary embodiment of the present invention.

As illustrated in FIG. 15, a roller 32T of the image forming apparatus 910 according to a comparative example is rendered unmovable. The roller 32T in the image forming apparatus 910 is retained at the position the same as that of the roller 32T in the image forming apparatus 10 disposed at the position for pressing the transfer belt 50 with the maximum force. In other words, the first tension is constantly applied to the transfer belt 50.

Evaluations

The evaluations of the image forming apparatus 10 and the image forming apparatus 910 are described now.

Evaluation Specifications

Evaluations are performed using a machine obtained by converting Color 1000 Press from Fuji Xerox Co., Ltd. into the image forming apparatus 10 and a machine obtained by converting Color 1000 Press from Fuji Xerox Co., Ltd. into the image forming apparatus 910. The process speed of the image forming apparatus 10 and the image forming apparatus 910 is set at 524 mm/s.

The evaluations are performed in the surrounding of the room temperature of 28° C. and the humidity of 85% RH.

The toner mass per area (TMA, mass of toner per unit area) of the Y toner, the M toner, and the C toner is set at 3.3 g/m$^2$, the TMA of the K toner is set at 3.7 g/m$^2$, and the TMA of the W toner is set at 8.2 g/m$^2$.

The toner layer forming portion 30W used in the evaluations is the one disposed downstream (to the left in FIG. 13), in the belt rotation direction, of the non-white color toner layer forming portions 30Y, 30M, 30C, and 30K, not the one disposed upstream of the non-white color toner layer forming portions 30Y, 30M, 30C, and 30K.

The evaluations are performed using metallic sheets from Gojo Paper MFG. Co., Ltd. (product No. 215-256, basis weight of 256 g/m$^2$, and thickness of 0.3 mm) and metallic sheets from Gojo Paper MFG. Co., Ltd. (product No. 220-1, basis weight of 350 g/m$^2$, and thickness of 0.5 mm). In the following description, the metallic sheets of the basis weight of 256 g/m$^2$ may be referred to as "ordinary paper sheets", and the metallic sheets of the basis weight of 350 g/m$^2$ may be referred to as "thick paper sheets".

Evaluation Images

A belt-like solid image (portion C in FIG. 18) having a width of 10 mm in the sheet transport direction (process direction) for each color is output on each of the ordinary paper sheets and the thick paper sheets from the position 20 mm apart from the leading end of each sheet.

Evaluation Method

Output images are visually inspected, and rated "poor" if the image has low image quality due to, for example, toner scattering, or rated "fair" if the image is acceptable as a product even with toner scattering.

Evaluation Results

Firstly, the evaluation results of the image forming apparatus 910 are described with the table shown in FIG. 11B.

Figure 18:
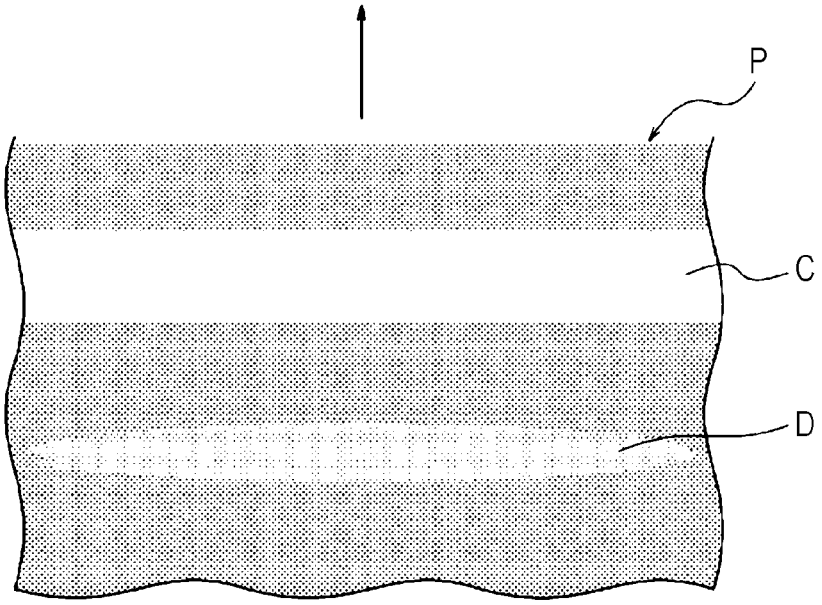
FIG. 18 is a schematic diagram showing the evaluation results for the image forming apparatus according to the comparative example, compared with the image forming apparatus according to the first exemplary embodiment of the present invention, using toner scattering on a recording medium.

As shown in the table in FIG. 11B, a toner image is formed with the W toner by the image forming apparatus 910 and, rated "poor" in an evaluation result when using a thick paper sheet. Other toner images are rated "fair" in different evaluation results. As illustrated in FIG. 18, the output image rated "poor" in the evaluation result has a portion (portion D in FIG. 18) to which the scattering W toner adheres at a position apart from the trailing end of the belt-like solid image (portion C in FIG. 18) having a width of 10 mm. The dotted portion in FIG. 18 is a portion in which an image is not formed.

The reason why the image is rated "poor" in the evaluation result is considered below.

Figure 16A:
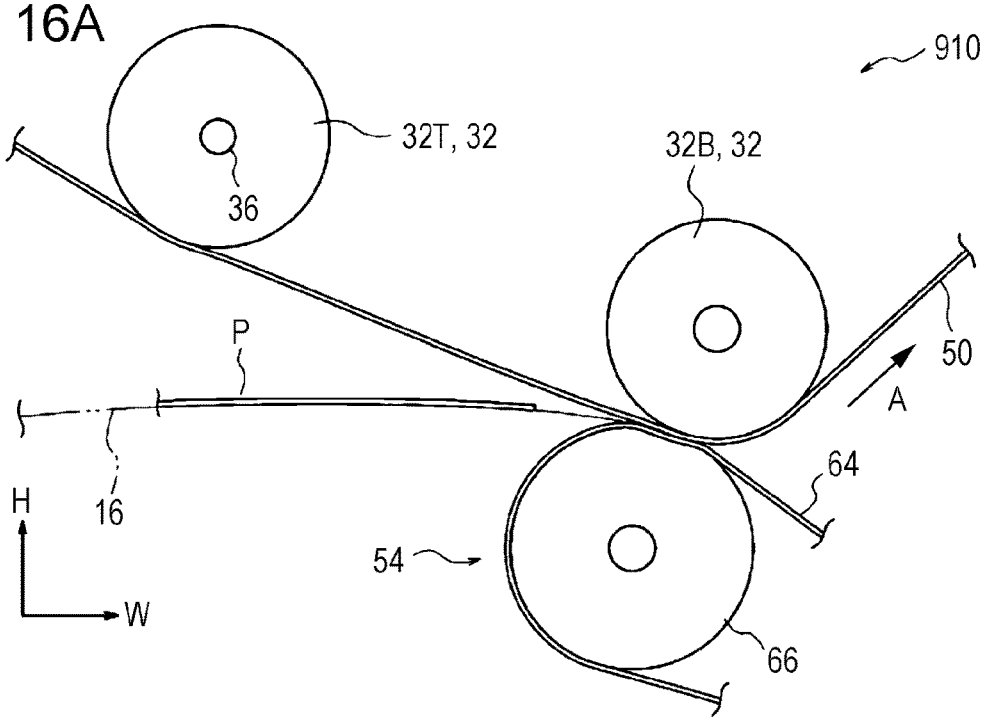
FIGS. 16A and 16B are side views of components, such as a second transfer portion and a transfer belt, of an image forming apparatus according to a comparative example, compared with the image forming apparatus according to the first exemplary embodiment of the present invention.
Figure 16B:
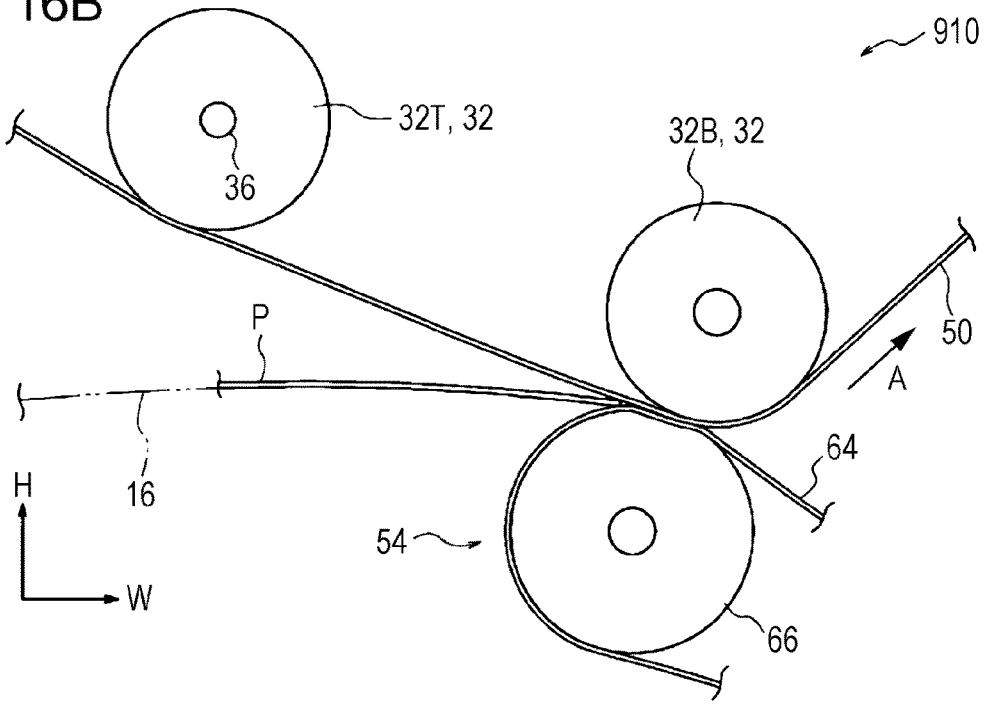
Figure 17A:
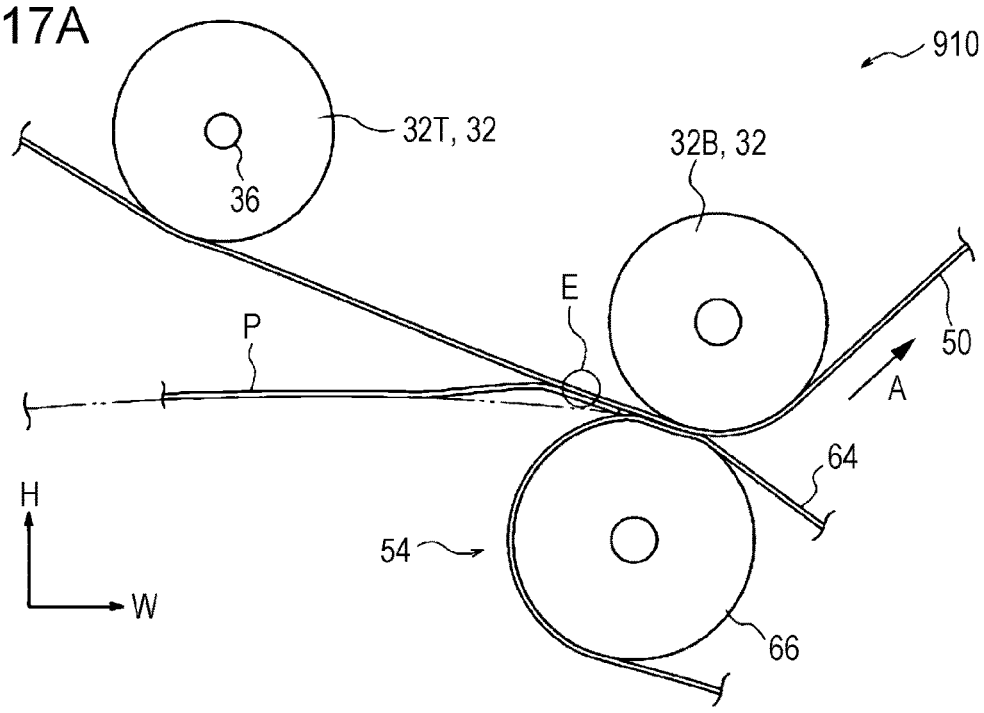
FIGS. 17A and 17B are side views of components, such as a second transfer portion and a transfer belt, of an image forming apparatus according to a comparative example, compared with the image forming apparatus according to the first exemplary embodiment of the present invention.
Figure 17B:
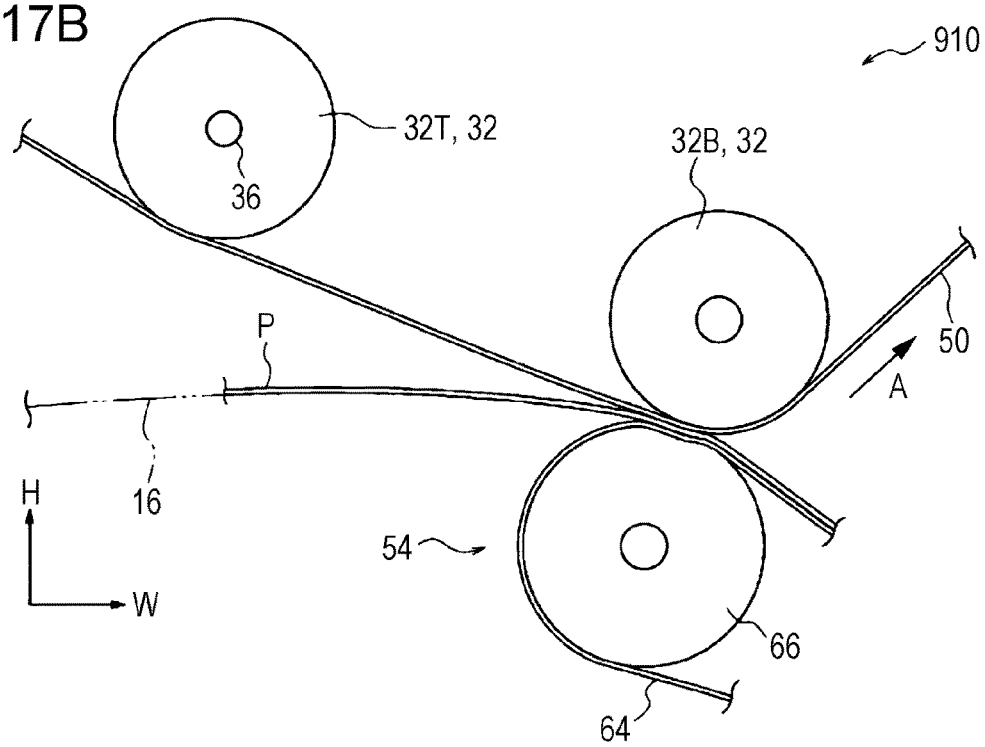

As illustrated in FIG. 16A, a sheet member P (thick paper sheet) on which a toner image is formed is transported toward the pressing portion (nip portion) formed between the roller 32B and the second transfer portion 54. As illustrated in FIGS. 16B and 17A, when the leading end of the transported sheet member P hits the pressing portion or a portion narrowed between the transfer belt 50 and the elastic belt 64, the leading end portion of the sheet member P is bent and collides with the transfer belt 50 (portion E in FIG. 17A). This collision vibrates the transfer belt 50 and scatters part of the W toner on the transfer belt 50, and the scattering toner adheres to the rotating transfer belt 50 again. The above-described output image (see FIG. 18) is possibly formed in this manner. As illustrated in FIG. 17B, the sheet member P having its leading end portion temporarily bent is transported while being held between the transfer belt 50 and the second transfer portion 54.

Now, the reason why only the W toner scatters is considered.

Figure 10:
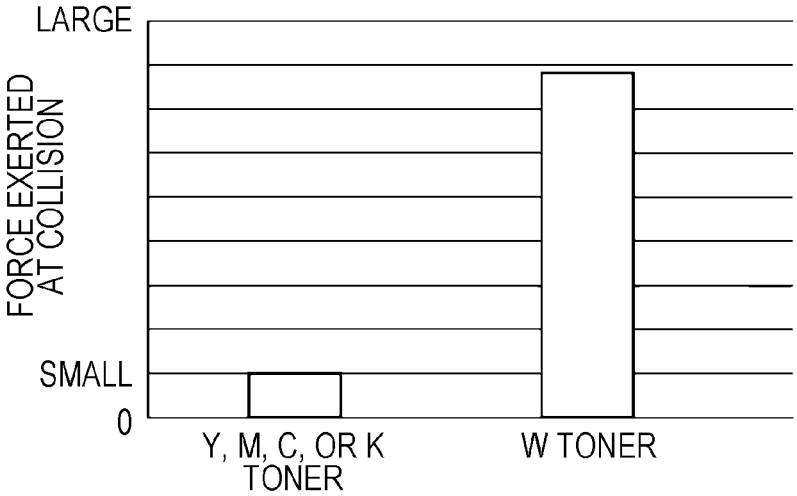
FIG. 10 is a graph showing evaluation results for the white toner and the color toner used in the image forming apparatus according to the first exemplary embodiment of the present invention.

FIG. 10 illustrates a force applied to each toner when the transfer belt 50 vibrates. The same vibration (acceleration) exerts a larger force on the W toner, having a large mass, than a force on the Y, M, C, and K toners, having a small mass. This is probably the reason why part of the W toner on the transfer belt 50 scatters while the Y, M, C, and K toners on the transfer belt 50 do not scatter.

Now, the reason why the W toner does not scatter when transferred to an ordinary paper sheet but scatters when transferred to a thick paper sheet is considered.

The thick paper sheet has a larger basis weight than the ordinary paper sheet. In other words, the thick paper sheet has higher flexural rigidity than the ordinary paper sheet. As illustrated in FIGS. 16B and 17A, the force exerted when the bent leading end portion of the sheet member P collides with the transfer belt 50 is higher in the case where the sheet member P is a thick paper sheet than that in the case where the sheet member P is an ordinary paper sheet.

Thus, the acceleration generated in the transfer belt 50 when the thick paper sheet collides with the transfer belt 50 is faster than the acceleration generated in the transfer belt 50 when the ordinary paper sheet collides with the transfer belt 50. This is possibly the reason why the W toner scatters when the W toner is transferred to the thick paper sheet.

The evaluation results of the image forming apparatus 10 are described using the table shown in FIG. 11A.

As described above, the setting portion 58 of the image forming apparatus 10 places the roller 32T at a position at which the roller 32T presses the transfer belt 50 with the minimum force when the mass of the toner of the uppermost toner layer in the toner image on the transfer belt 50 is equal to or exceeds the threshold (see FIG. 3). In the present exemplary embodiment, the threshold of the mass of the toner is $2.0\times10^{-10}$ g. The mass of the W toner (toner particles) is $0.51\times10^{-9}$ g, which is greater than the threshold. When the W toner is used in the uppermost toner layer on the transfer belt 50, the tension applied to the transfer belt 50 is thus set to the second tension, which is smaller than the first tension.

As shown in the table in FIG. 11A, when the image forming apparatus 10 forms toner images also when using the W toner on the thick paper sheet, the toner images are rated "fair" in all the evaluation results.

Now, the reason why the toner image formed on the thick paper sheet with the W toner is rated "fair" in the evaluation result is considered. The relevant toner image formed by the image forming apparatus 910 is rated "poor" in the evaluation result.

As described above, the tension applied to the transfer belt 50 of the image forming apparatus 10 is smaller than the tension applied to the transfer belt 50 of the image forming apparatus 910. Thus, in the image forming apparatus 10, when the leading end portion of the sheet member P is bent and collides with the transfer belt 50 (portion E in FIG. 17A), the acceleration of vibrations caused in the transfer belt 50 by the collision is probably reduced. Thus, the scattering of the W toner on the transfer belt 50 is reduced.

As described above, the transport angle (angle R1 in FIG. 1B) formed when the tension applied to the transfer belt 50 is set to the second tension is larger than the transport angle (angle R2 in FIG. 1A) formed when the tension applied to the transfer belt 50 is set to the first tension. Thus, when the leading end of the transported sheet member P hits on the pressing portion, the leading end portion of the sheet member P is bent to probably reduce the force with which it collides against the transfer belt 50. Thus, the scattering of the W toner on the transfer belt 50 is suppressed.

The reduction of the tension applied to the transfer belt 50 may vary the pressing force with which the sheet member P is pressed against the transfer belt 50. However, the quality variation of the output image due to the variation of the pressing force is on the level acceptable as a product.

Specifically, in the image forming apparatus 10, when the uppermost toner layer on the transfer belt 50 is a W toner layer, the setting portion 58 reduces the tension of the transfer belt 50. Thus, in the image forming apparatus 10, the tension of the transfer belt 50 is not constantly reduced and the quality variation of the output image is thus suppressed, while the scattering of the W toner on the transfer belt 50 is suppressed.

Operations of Related Components

The operations of related components are described now.

First, the case where a toner image is formed by using only the Y, M, C, and K color toners 300 is described. Here, a thick paper sheet is used as the sheet member P. Before the image forming operation (before job execution), the roller 32T is placed at a position at which it presses the transfer belt 50 with the maximum force (see FIG. 2).

Figure 9A:
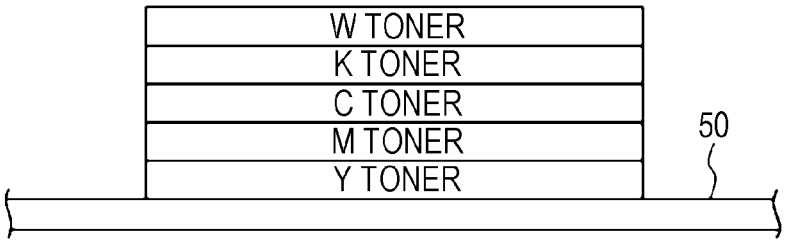
FIGS. 9A and 9B are schematic diagrams of a toner image formed by superposing toner layers on the transfer belt in the image forming apparatus according to the first exemplary embodiment of the present invention.
Figure 9B:
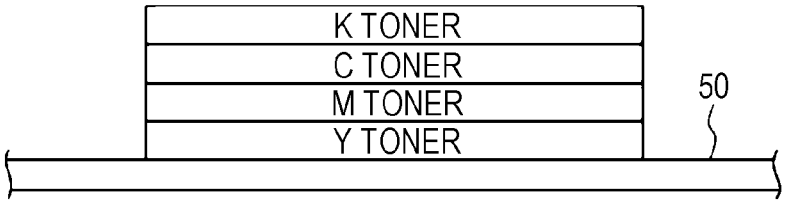

Toner layers formed by the toner layer forming portions 30Y, 30M, 30C, and 30K are first-transferred to the rotating transfer belt 50 by the first transfer rollers 52 (FIG. 13). As illustrated in FIG. 9B, the toner image obtained by superposing the Y toner layer, the M toner layer, the C toner layer, and the K toner layer in this order is formed (held) on the transfer belt 50. Here, the uppermost one of the toner layers disposed on the transfer belt 50 and constituting the toner image is the K toner layer. The mass of the toner of the uppermost toner layer is $0.65\times10^{-10}$ g, which is below the threshold. Thus, the setting portion 58 keeps the position of the roller 32T that presses the transfer belt 50 with the maximum force (see FIG. 2). In other words, the setting portion 58 maintains the tension applied to the transfer belt 50 at the first tension, which is greater than the second tension.

When the transported sheet member P is then transported while being held between the transfer belt 50 and the second transfer portion 54 and while being pressed against the rotating transfer belt 50, the superposed toner image on the transfer belt 50 is transferred to the sheet member P (see FIG. 13).

Now, described is a case where a toner image including the W toner layer as a base coat for the Y, M, C, and K color toners 300 is formed to enhance the color reproducibility. A device disposed downstream (to the left in FIG. 13) of the non-white color toner layer forming portions 30Y, 30M, 30C, and 30K in the belt rotation direction is used as the toner layer forming portion 30W that forms the W toner layer. Thick paper sheets are used as the sheet members P.

The toner layers formed by the toner layer forming portions 30Y, 30M, 30C, 30K, and 30W are first-transferred to the rotating transfer belt 50 by the respective first transfer rollers 52 (FIG. 13). As illustrated in FIG. 9A, a toner image obtained by superposing the Y toner layer, the M toner layer, the C toner layer, the K toner layer, and the W toner layer in this order is formed (held) on the transfer belt 50. Here, the uppermost one of the toner layers disposed on the transfer belt 50 and constituting the toner image is the W toner layer. The mass information of the W toner is input in advance. The mass of the toner of the uppermost toner layer is $0.51\times10^{-9}$ g, which exceeds the threshold. Thus, the setting portion 58 moves the roller 32T to a position at which it presses the transfer belt 50 with the minimum force (see FIG. 3). In other words, the setting portion 58 sets the tension applied to the transfer belt 50 to the second tension, which is smaller than the first tension.

The transported sheet member P is transported while being held between the transfer belt 50 and the second transfer portion 54 and while being pressed against the rotating transfer belt 50, so that the superposed toner image on the transfer belt 50 is transferred to the sheet member P (see FIG. 13).

Conclusion

As described above, when the uppermost one of the toner layers on the transfer belt 50 is the W toner layer, the mass of the toner of the uppermost toner layer is equal to or exceeds the threshold. Thus, in the image forming apparatus 10, the tension applied to the transfer belt 50 is set to the second tension, which is smaller than the first tension. This structure prevents the transfer belt 50 from vibrating as a result of the leading end of the transported sheet member P coming into contact with the pressing portion, and thus prevents the W toner on the transfer belt 50 from scattering. In other words, the amount of toner that scatters on the transfer belt 50 due to the impact caused when the transported sheet member P comes into contact with the pressing portion is reduced compared to the case where the tension applied to the transfer belt 50 remains constant.

In other words, the transport angle R1 (see FIG. 1B) formed when the tension applied to the transfer belt 50 is set to the second tension is greater than the transport angle R2 (see FIG. 1A) formed when the tension applied to the transfer belt 50 is set to the first tension. Thus, when the leading end of the transported sheet member P comes into contact with the pressing portion, the leading end portion of the sheet member P is bent and the force with which it collides against the transfer belt 50 is reduced. Thus, scattering of the W toner on the transfer belt 50 is suppressed.

Suppressing the scattering of the W toner on the transfer belt 50 reduces the quality degradation of the output images.

Second Exemplary Embodiment

Examples of a transfer device and an image forming apparatus according to a second exemplary embodiment of the present invention are described with reference to FIGS. 19 to 23. Here, portions of the second exemplary embodiment that differ from those of the first exemplary embodiment are mostly described.

Figure 23:
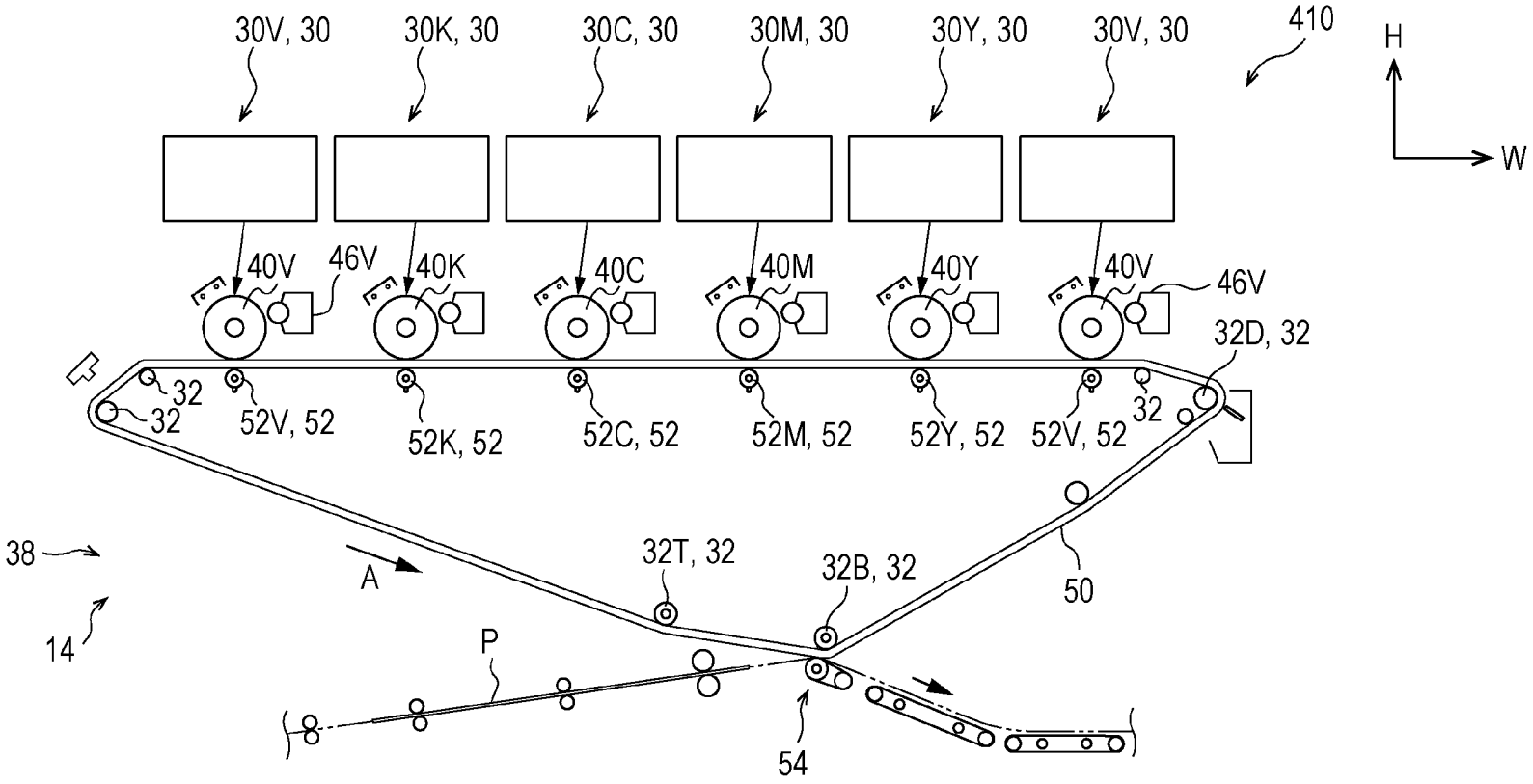
FIG. 23 is a diagram of the structure of a toner layer forming portion and a transfer portion of the image forming apparatus according to the second exemplary embodiment of the present invention.

As illustrated in FIG. 23, an image forming apparatus 410 according to the second exemplary embodiment includes toner layer forming portions 30 for five colors of yellow (Y), magenta (M), cyan (C), black (K), and silver (V). Two toner layer forming portions 30 are provided for silver (V). The toner layer forming portions 30 for silver (V), yellow (Y), magenta (M), cyan (C), black (K), and silver (V) are arranged side by side in the horizontal direction in this order from the upstream side in the rotation direction of the transfer belt 50 (see arrow A in FIG. 23).

Silver Toner 100

A silver toner 100 (hereinafter may be referred to as "V toner") is used in a developing device 46V for each toner layer forming portion 30V.

Figure 19:
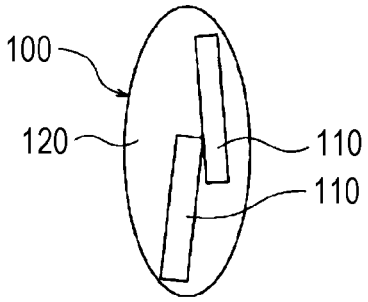
FIG. 19 is a schematic diagram of a silver toner used in the image forming apparatus according to a second exemplary embodiment of the present invention.

As illustrated in FIG. 19, the silver toner 100 (flat toner) contains a flat pigment 110 and a binding resin 120. The flat pigment 110 is formed from aluminum (an example of a metal). A known resin material is used as the binding resin 120, and the binding resin 120 has lower electric conductivity than the flat pigment 110.

Figure 20A:
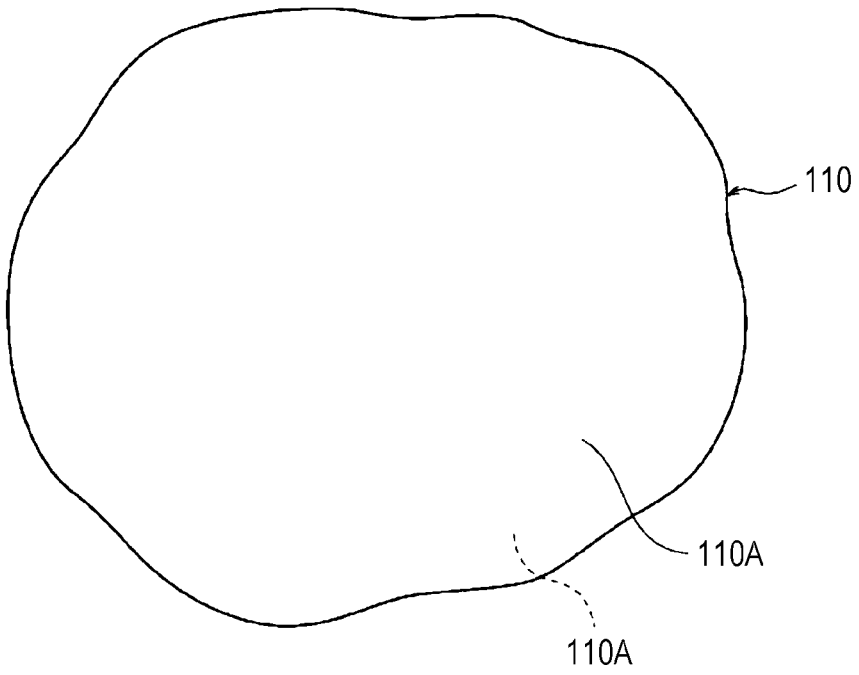
FIGS. 20A and 20B are schematic diagrams of a pigment of a silver toner used in the image forming apparatus according to the second exemplary embodiment of the present invention.
Figure 20B:
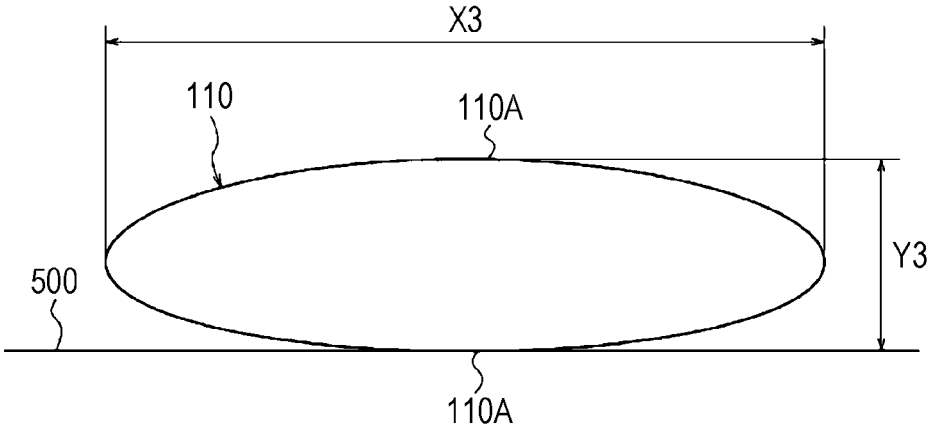

As illustrated in FIG. 20B, when the flat pigment 110 is placed on the flat surface 500 and viewed from the side, the flat pigment 110 has a dimension X3 in the lateral direction that is longer than a dimension Y3 in the vertical direction.

When the flat pigment 110 illustrated in FIG. 20B is viewed from the top, the flat pigment 110 spreads widely as illustrated in FIG. 20A unlike when viewed from the side. The flat pigment 110 has a pair of reflection surfaces 110A facing upward and downward when the flat pigment 110 is placed on the flat surface 500 (see FIG. 20B). As described above, the flat pigment 110 has a flat shape.

Since the flat pigment 110 has a flat shape, the silver toner 100 containing the flat pigment 110 also has a flat shape, following the contour of the flat pigment 110. Thus, when the silver toner 100 is placed on the flat surface 500 and viewed from the side, the silver toner 100 has a dimension A3 in the lateral direction longer than a dimension C3 in the vertical direction, as illustrated in FIG. 21B.

Figure 21A:
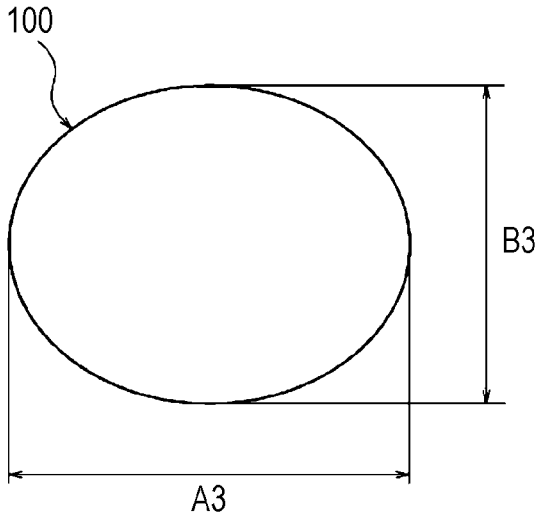
FIGS. 21A and 21B are schematic diagrams of a silver toner used in the image forming apparatus according to the second exemplary embodiment of the present invention.
Figure 21B:
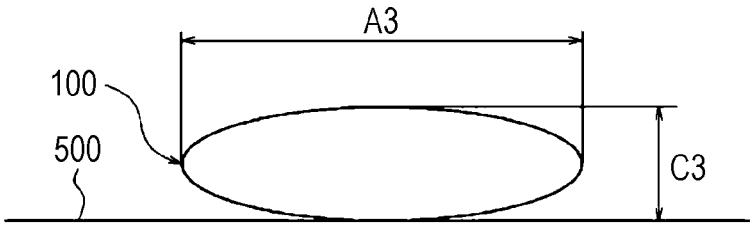

When the silver toner 100 illustrated in FIG. 21B is viewed from the top, the silver toner 100 spreads widely to have a substantially circular shape (substantially elliptic shape) as illustrated in FIG. 21A, unlike when viewed from the side.

Here, the relationship A3≥B3>C3 holds true, where A3 denotes the maximum length (maximum diameter) of the silver toner 100 viewed from the top, B3 denotes an orthogonal length orthogonal to the maximum length A3, and C3 denotes a thickness of the silver toner 100 viewed from the top (dimension in the vertical direction).

In the present exemplary embodiment, an example used as the V toner has a specific gravity of 1.6 g/cm$^3$, a maximum length A3 of 12 μm, an orthogonal length B3 of 12 μm, and a thickness C3 of 2 μm. Thus, the V toner (toner particle) has a mass of $0.24\times10^{-9}$ g.

The maximum length A3, the orthogonal length B3, and the thickness C3 are obtained by observing the toner in an enlarged manner using a color laser microscope "VK-9700" (from KEYENCE CORPORATION) and by calculating the maximum length of the toner flat surface using image processing software.

The silver toner 100 is used as a base coat for the non-white colors on the sheet member P. Specifically, the solid layer (solid image) of the silver toner 100 is formed on the sheet member P as a base coat for the non-white colors to provide glossiness to the toner image.

A case is described where this structure forms a toner image including a V toner layer for use as a base coat for the Y, M, C, and K color toners 300 to enhance the image glossiness. A device disposed on the downstream side (to the left in FIG. 23) of the non-white color toner layer forming portions 30Y, 30M, 30C, and 30K in the belt rotation direction is used as the toner layer forming portion 30V that forms the V toner layer. A thick paper sheet is used as the sheet member P. Before the image forming operation (before job execution), the roller 32T of the image forming apparatus 410 is placed at a position at which it presses the transfer belt 50 with the maximum force (see FIG. 2).

Figure 22:
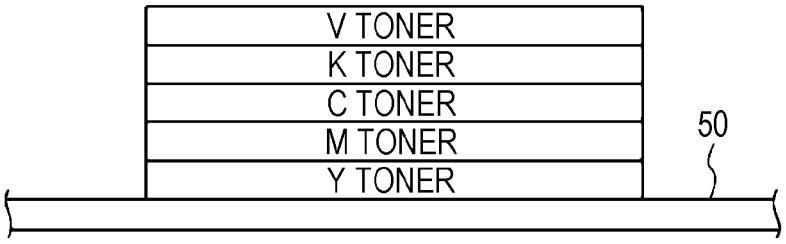
FIG. 22 is a schematic diagram of a toner image formed by superposing toner layers on a transfer belt in the image forming apparatus according to the second exemplary embodiment of the present invention.

Toner layers formed by the toner layer forming portions 30Y, 30M, 30C, 30K, and 30V are first-transferred to the rotating transfer belt 50 by the first transfer rollers 52 (FIG. 23). As illustrated in FIG. 22, a toner image obtained by superposing the Y toner layer, the M toner layer, the C toner layer, the K toner layer, and the V toner layer in this order is formed (held) on the transfer belt 50. Here, the uppermost one of the toner layers disposed on the transfer belt 50 and constituting the toner images is the V toner layer. The mass of the toner of the uppermost toner layer is $0.24\times10^{-9}$ g, which exceeds the threshold. Thus, the setting portion 58 moves the roller 32T to a position at which it presses the transfer belt 50 with the minimum force (see FIG. 3). In other words, the setting portion 58 sets the tension applied to the transfer belt 50 to the second tension, which is smaller than the first tension.

The transported sheet member P is then transported while being held between the transfer belt 50 and the second transfer portion 54 and while being pressed against the rotating transfer belt 50. Thus, the superposed toner image on the transfer belt 50 is transferred to the sheet member P (see FIG. 23).

As described above, when the uppermost one of the toner layers on the transfer belt 50 is the V toner layer, the mass of the toner of the uppermost toner layer exceeds the threshold. Thus, the image forming apparatus 10 applies the second tension, which is smaller than the first tension, to the transfer belt 50. This structure prevents the transfer belt 50 from vibrating as a result of the leading end of the transported sheet member P coming into contact with the pressing portion, and suppresses scattering of the V toner on the transfer belt 50.

Other operations are the same as those in the case of the first exemplary embodiment.

Third Exemplary Embodiment

Examples of a transfer device and an image forming apparatus according to a third exemplary embodiment of the present invention are described with reference to FIG. 24. Portions of the third exemplary embodiment that differ from those of the first exemplary embodiment are mostly described.

Figure 24:
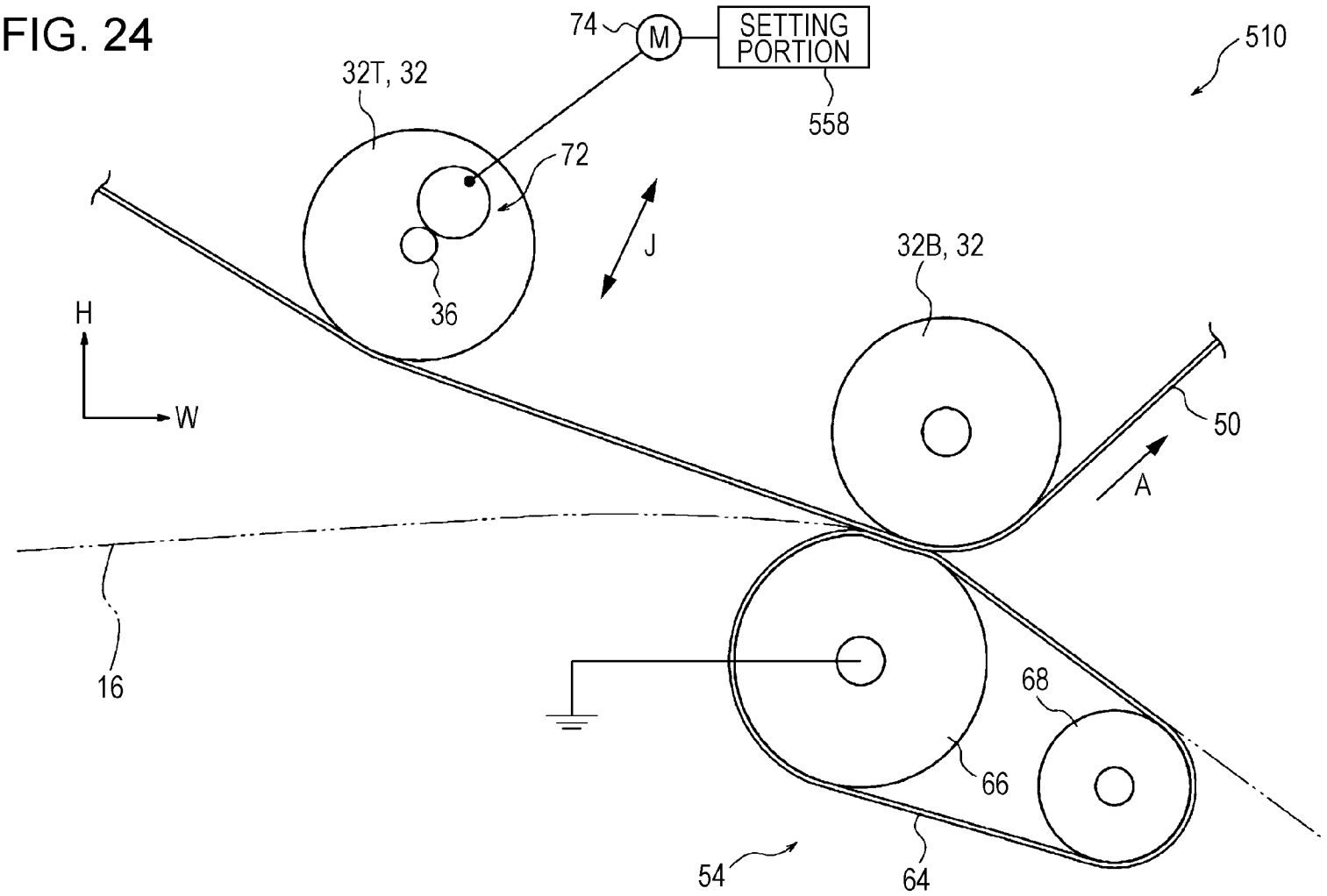
FIG. 24 is a sectional view of components, such as a second transfer portion and a transfer belt, of an image forming apparatus according to a third exemplary embodiment of the present invention.

As illustrated in FIG. 24, an image forming apparatus 510 according to the third exemplary embodiment includes a setting portion 558, which drives the motor 74 to rotate the eccentric cams 72. The setting portion 558 sets the tension applied to the transfer belt 50 to the second tension, which is smaller than the first tension, when the mass of the toner (toner particles) of the uppermost toner layer in the toner images on the transfer belt 50 is equal to or exceeds the threshold and the basis weight of the sheet member P is equal to or exceeds the threshold.

Here, in the present exemplary embodiment, the threshold of the basis weight of the sheet member P is 350 g/m$^2$. As described above, the basis weight of the thick paper sheet is 350 g/m$^2$, and the basis weight of the ordinary paper sheet is 256 g/m$^2$.

In this structure, the setting portion 558 sets the tension applied to the transfer belt 50 to the second tension, which is smaller than the first tension, when the mass of the toner of the uppermost toner layer in the toner images on the transfer belt 50 is equal to or exceeds the threshold and the thick paper sheet is used as the sheet member P.

On the other hand, when an ordinary paper sheet is used as the sheet member P, the setting portion 558 retains the tension applied to the transfer belt 50 at the first tension, which is greater than the second tension, even when the uppermost one of the toner layers on the transfer belt 50 is the W toner layer. As is clear from the table in FIG. 11B, when the ordinary paper sheet is used, the toner image is rated "fair" in the evaluation result even when the tension applied to the transfer belt 50 is the first tension.

In this manner, when the basis weight of the sheet member P is below the threshold, the tension applied to the transfer belt 50 is set to the first tension even when the uppermost one of the toner layers on the transfer belt 50 is the W toner layer, so that the output image is on the level acceptable as a product and has smaller quality variation.

Other operations are the same as those of the first exemplary embodiment.

Fourth Exemplary Embodiment

Examples of a transfer device and an image forming apparatus according to a fourth exemplary embodiment of the present invention are described with reference to FIGS. 25 and 26. Portions of the fourth exemplary embodiment that differ from those of the first exemplary embodiment are mostly described.

Figure 25:
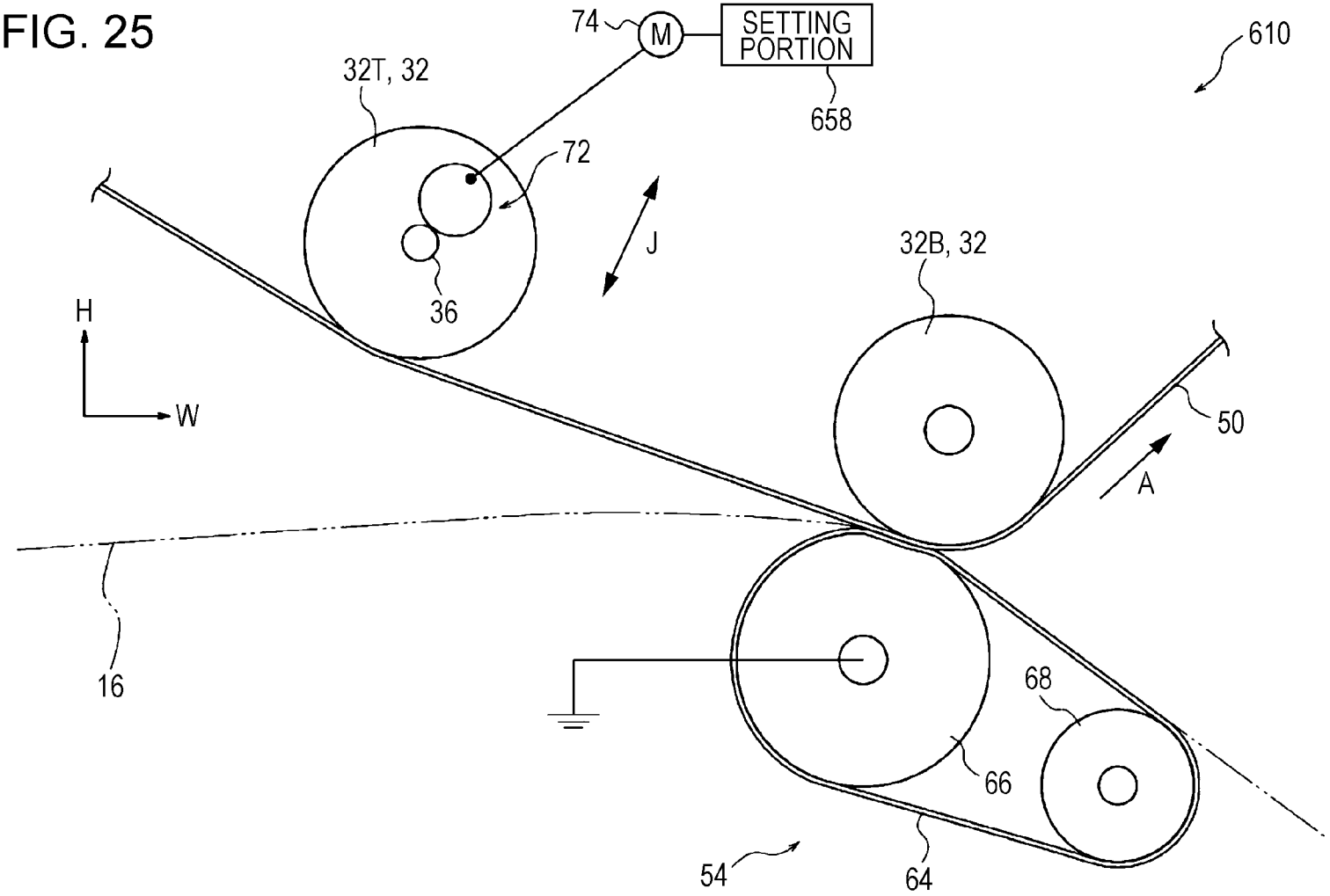
FIG. 25 is a sectional view of components, such as a second transfer portion and a transfer belt, of an image forming apparatus according to a fourth exemplary embodiment of the present invention.
Figure 26:
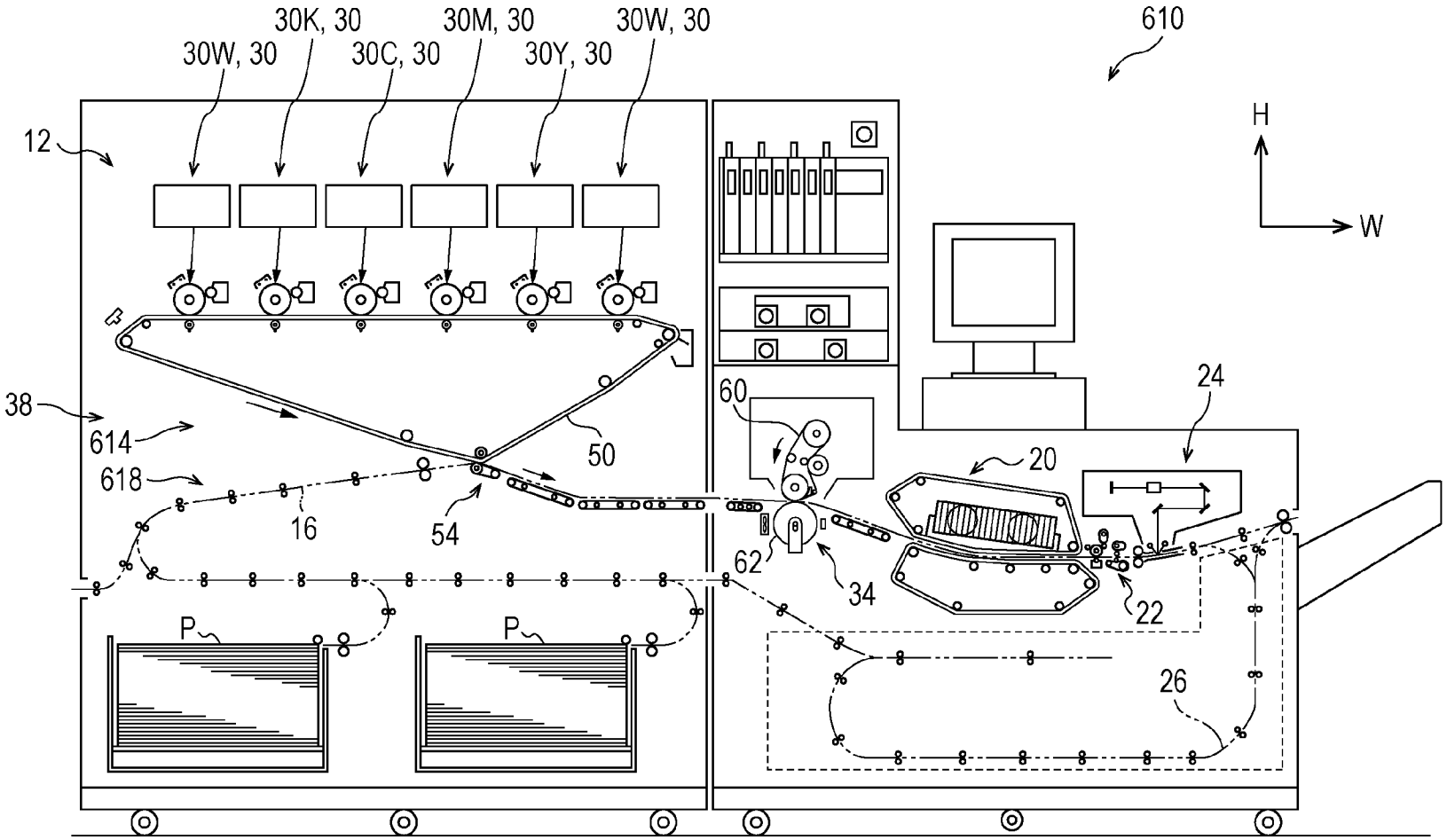
FIG. 26 is a schematic diagram of the structure of the image forming apparatus according to the fourth exemplary embodiment of the present invention.

As illustrated in FIG. 25, an image forming apparatus 610 according to the fourth exemplary embodiment includes a setting portion 658, which drives the motor 74 to rotate the eccentric cams 72. The setting portion 658 sets the tension applied to the transfer belt 50 to the second tension, which is smaller than the first tension, and reduces the transportation speed of the sheet member P, when the mass of the toner of the uppermost toner layer on the transfer belt 50 is equal to or exceeds the threshold.

Specifically, a transport device 618 (see FIG. 26), which is an example of a transporting device that transports the sheet members P, transports the sheet members P at a first transportation speed or a second transportation speed, which is slower than the first transportation speed. The first transportation speed is a speed at which the transport device 18 according to the first exemplary embodiment transports the sheet members P.

The toner layer forming portions 30 and a transfer portion 614 are operable at a first process speed, at which toner images are transferred to the sheet member P transported at the first transportation speed, and a second process speed, at which toner images are transferred to the sheet member P transported at the second transportation speed. The first process speed is a speed at which the transfer portion 14 according to the first exemplary embodiment transfers the toner images to the sheet member P.

In this structure, the setting portion 658 sets the tension applied to the transfer belt 50 to the second tension, smaller than the first tension, when the mass of the toner of the uppermost toner layer on the transfer belt 50 is equal to or exceeds the threshold. In addition, the setting portion 658 causes the transport device 618 to transport the sheet member P at the second transportation speed, and causes the toner layer forming portions 30 and the transfer portion 614 to transfer the toner images to the sheet member P at the second process speed.

In this manner, the transportation speed of the sheet member P is reduced when the image quality is more likely to be reduced by scattering of the W toner. Thus, bending of the leading end portion of the sheet member P as a result of the leading end of the sheet member P coming into contact with the pressing portion is reduced compared to the case where the transportation speed is kept at the constant rate.

Thus, reducing the transportation speed of the sheet member P reduces the amount of scattering toner on the transfer belt 50 due to the impact caused when the transported sheet member P comes into contact with the pressing portion, compared to the case where the transportation speed is kept at the constant rate.

Other operations are the same as those of the first exemplary embodiment.

Fifth Exemplary Embodiment

An example of an image forming apparatus according to a fifth exemplary embodiment of the present invention is described with reference to FIGS. 27 and 28. Portions of the fifth exemplary embodiment that differ from those of the first exemplary embodiment are mostly described.

Figure 27:
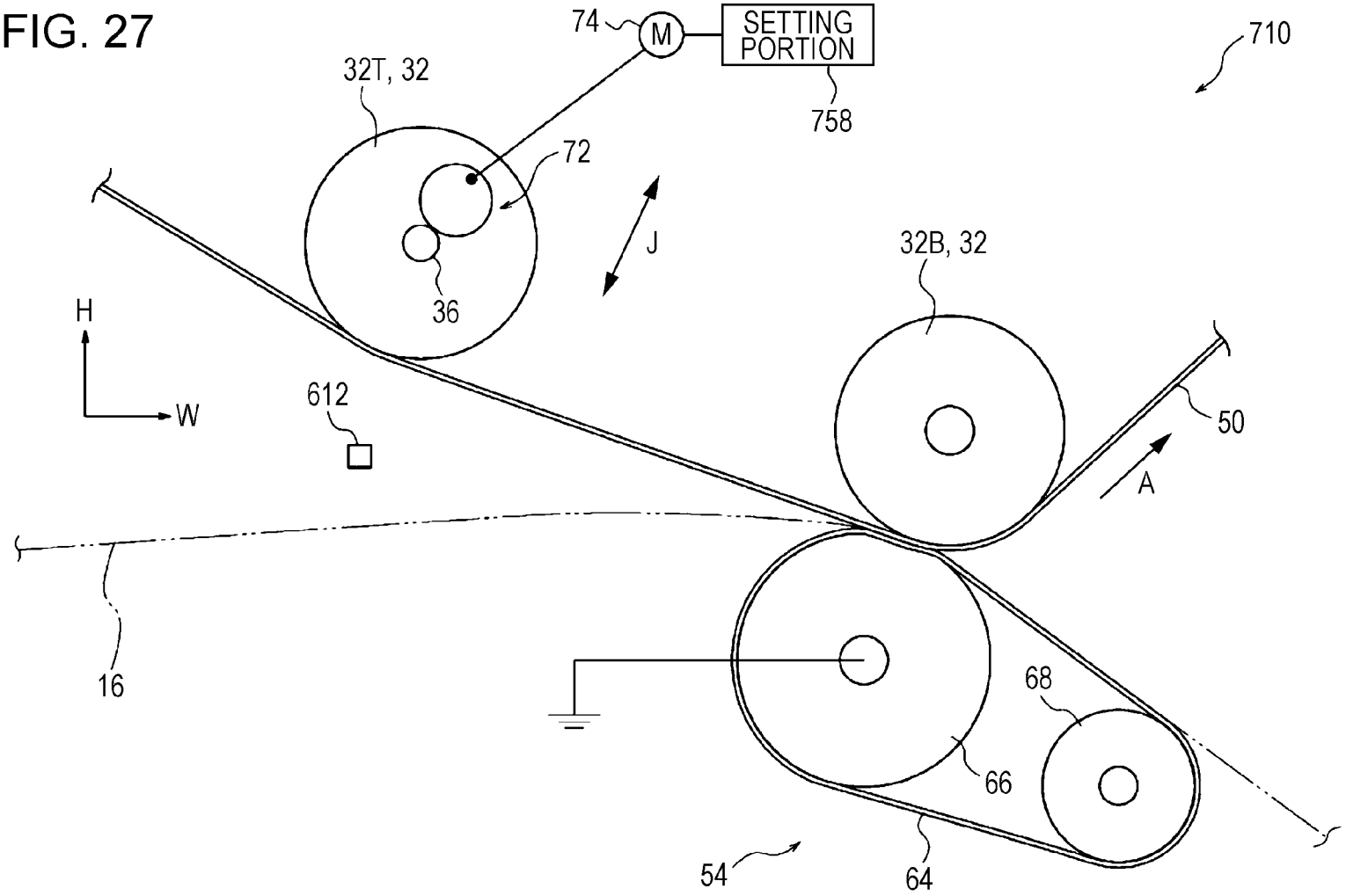
FIG. 27 is a sectional view of components, such as a second transfer portion and a transfer belt, of an image forming apparatus according to a fifth exemplary embodiment of the present invention.
Figure 28:
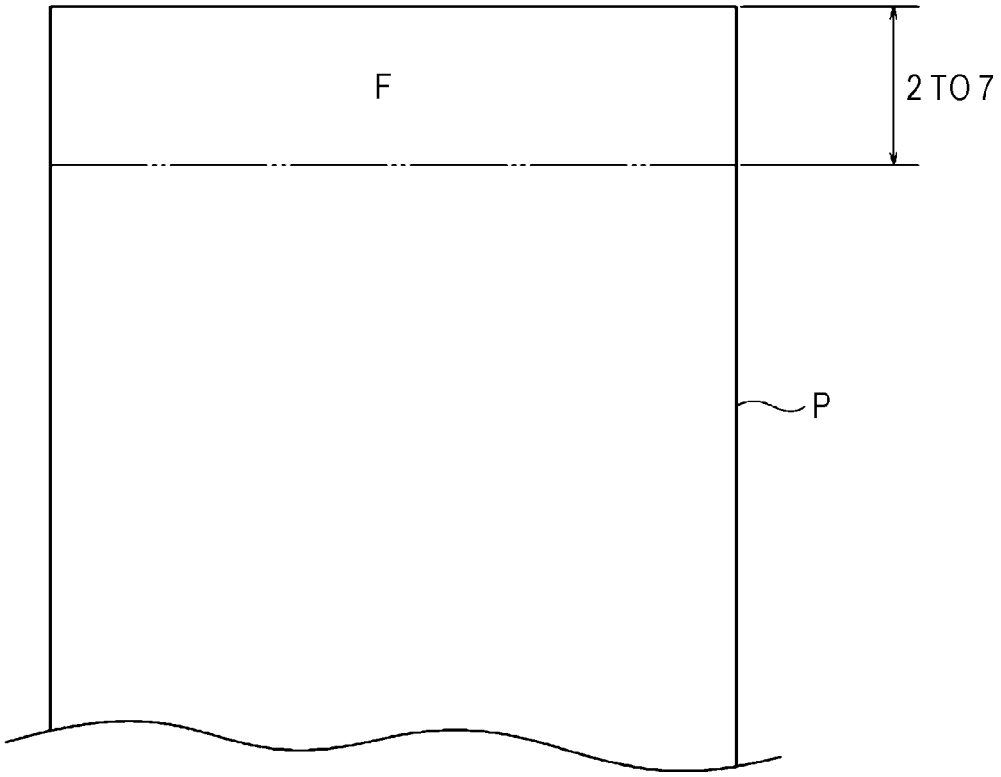
FIG. 28 is a schematic diagram of a range of a sheet member firmly pressed by a pressing portion, the sheet member used in the image forming apparatus according to the fifth exemplary embodiment of the present invention.

As illustrated in FIG. 27, an image forming apparatus 710 according to a fifth exemplary embodiment includes a setting portion 758, which drives the motor 74 to rotate the eccentric cams 72. The setting portion 758 sets the tension applied to the transfer belt 50 to the second tension, which is smaller than the first tension, when the mass of the toner of the uppermost toner layer on the transfer belt 50 is equal to or exceeds the threshold only while the leading end portion of the sheet member P is held between the transfer belt 50 and the second transfer portion 54.

Specifically, a sensor 612, which detects the leading end of the transported sheet member P, is disposed on the upstream side, in the sheet transport direction, of the pressing portion disposed between the roller 32B and the second transfer portion 54.

In this structure, the setting portion 758 that has received detection information from the sensor 612 sets the tension applied to the transfer belt 50 to the second tension, which is smaller than the first tension, by moving the roller 32T for only a predetermined time period. Specifically, the setting portion 758 sets the tension applied to the transfer belt 50 to the second tension for the sheet member P within the range of 2 mm to 7 mm from the leading end of the sheet member P (range F in FIG. 28).

Specifically, "the leading end portion of the sheet member P" refers to the limited range of 2 mm to 7 mm from the leading end of the sheet member P.

In this manner, when the mass of the toner of the uppermost toner layer on the transfer belt 50 is equal to or exceeds the threshold, the setting portion 758 sets the tension applied to the transfer belt 50 to the second tension only while the leading end portion of the sheet member P is held between the transfer belt 50 and the second transfer portion 54.

Thus, the output image is on the level acceptable as a product and has smaller quality variation, compared to the case where the second tension is continuously applied to the transfer belt throughout the period in which the sheet member P is held between the transfer belt 50 and the second transfer portion 54.

Other operations are the same as those of the first exemplary embodiment.

Although specific exemplary embodiments of the present invention are described in detail, the present invention is not limited to these exemplary embodiments. It is clear to persons having ordinary skill in the art that the present invention may be embodied in various other exemplary embodiments within the scope of the present invention. For example, in the above-described exemplary embodiments, each of the setting portions 58, 558, 658, and 758 sets the tension applied to the transfer belt 50 to the second tension when the mass of the toner of the uppermost toner layer on the transfer belt 50 is equal to or exceeds the threshold. Alternatively, each of the setting portions 58, 558, 658, and 758 may set the tension applied to the transfer belt 50 to the second tension when the toner of the uppermost toner layer on the transfer belt 50 contains a pigment formed from a metal or a metallic oxide.

Specifically, each of the setting portions 58, 558, 658, and 758 may set the tension applied to the transfer belt 50 to the second tension when the toner of the uppermost one of the toner layers constituting the toner image and disposed on the transfer belt 50 is a W toner or a V toner. This structure suppresses scattering of the W toner or the V toner on the transfer belt 50 compared to the case where the tension applied to the transfer belt 50 is constantly kept at the first tension.

In the third exemplary embodiment, the setting portion 558 sets the tension applied to the transfer belt 50 to the second tension when the mass of the toner of the uppermost toner layer on the transfer belt 50 is equal to or exceeds the threshold and the basis weight of the sheet member P is equal to or exceeds the threshold. Instead, the setting portion 558 may set the tension applied to the transfer belt 50 to the second tension when the toner of the uppermost toner layer on the transfer belt 50 contains a pigment formed from a metal or a metallic oxide and the basis weight of the sheet member P is equal to or exceeds the threshold.

In the fourth exemplary embodiment, the setting portion 658 sets the tension applied to the transfer belt 50 to the second tension and reduces the transportation speed of the sheet member P, when the mass of the toner of the uppermost toner layer on the transfer belt 50 is equal to or exceeds the threshold. Instead, the setting portion 658 may set the tension applied to the transfer belt 50 to the second tension and reduce the transportation speed of the sheet member P, when the toner of the uppermost toner layer on the transfer belt 50 contains a pigment formed from a metal or a metallic oxide.

In the fifth exemplary embodiment, the setting portion 758 sets the tension applied to the transfer belt 50 to the second tension when the mass of the toner of the uppermost toner layer on the transfer belt 50 is equal to or exceeds the threshold and only while the leading end portion of the sheet member P is held between the transfer belt 50 and the second transfer portion 54. Instead, the setting portion 758 may set the tension applied to the transfer belt 50 to the second tension when the toner of the uppermost toner layer on the transfer belt 50 contains a pigment formed from a metal or a metallic oxide and only while the leading end portion of the sheet member P is held between the transfer belt 50 and the second transfer portion 54.

In the above-described exemplary embodiment, the volumetric average particle diameter is used to calculate the mass of the white toner 200 or the color toners 300. Instead, the particle diameter averaged by the number of particles may be used to calculate the mass. The particle diameter averaged by the number of particles may be measured by a charge spectrometer (E-Spart ANALYZER) from HOSOKAWA MICRON CORPORATION. This is a measuring device that detects the movement of particles in the aerial vibration field in the electric field by a laser Doppler method and concurrently measures the amount of electric charge and the particle diameter of individual particles from the data. The data of 3000 toner particles are input to this device and the average of the individual particle diameter data is the particle diameter averaged by the number of particles.

In each of the above-described exemplary embodiment, the present application is described using a tandem image forming apparatus 10 that develops a latent image on a single image carrier 40 with a single developing device 46. Instead, the image forming apparatus 10 may be a revolver (6 cycle) image forming apparatus that develops a latent image on a single image carrier with multiple developing devices.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A transfer device, comprising:

a holding body that holds a toner image and to which a first tension and a second tension, which is smaller than the first tension, are applied;

a transfer body that includes a second transfer portion and transfers the toner image to a recording medium while transporting the recording medium between the second transfer portion and the holding body; and a setting portion that sets tension applied to the holding body to the second tension when a mass of a toner of an uppermost toner layer constituting the toner image and disposed on the holding body is equal to or exceeds a threshold.

2. A transfer device, comprising:

a holding body that holds a toner image and to which a first tension and a second tension, which is smaller than the first tension, are applied;

a transfer body that includes a second transfer portion and transfers the toner image to a recording medium while transporting the recording medium between the second transfer portion and the holding body; and a setting portion that sets tension applied to the holding body to the second tension when a toner of an uppermost toner layer constituting the toner image and disposed on the holding body contains a pigment formed from a metal or a metallic oxide.

3. A transfer device, comprising:

a holding body that holds a toner image and to which a first tension and a second tension, which is smaller than the first tension, are applied;

a transfer body that includes a second transfer portion and transfers the toner image to a recording medium while transporting the recording medium between the second transfer portion and the holding body; and a setting portion that sets tension applied to the holding body to the second tension when a mass of a toner of an uppermost toner layer constituting the toner image and disposed on the holding body is equal to or exceeds a threshold and a basis weight of the recording medium is equal to or exceeds a threshold.

4. The transfer device according to claim 1, wherein an angle formed by the holding body and the recording medium held between the holding body and the transfer body is larger when the setting portion sets the tension to the second tension than when the setting portion sets the tension to the first tension.

5. The transfer device according to claim 1, wherein the transfer body transports the recording medium between the transfer body and the holding body by holding the recording medium at a leading end portion of the recording medium, and wherein under conditions where the setting portion sets the tension applied to the holding body to the second tension, the setting portion sets the tension to the second tension only while the holding body is holding the leading end portion of the recording medium.

6. The transfer device according to claim 1, wherein under conditions different from conditions where the setting portion sets the tension to the second tension, the setting portion sets the tension to the first tension.

7. An image forming apparatus, comprising:

the transfer device according to claim 1; and an image forming unit that forms a toner image held on the holding body of the transfer device.

8. The image forming apparatus according to claim 7, further comprising:

a transporting device that transports a recording medium to which a toner image is transferred with a first transportation speed and a second transportation speed, which is slower than the first transportation speed, wherein under conditions where the setting portion sets the tension to the second tension, the setting portion sets a speed at which the transporting device transports the recording medium to the second transportation speed.

* * * * *